US009020406B2

(12) United States Patent
Igarashi et al.

(10) Patent No.: US 9,020,406 B2
(45) Date of Patent: Apr. 28, 2015

(54) IMAGE FORMING APPARATUS AND METHOD OF CORRECTING COLOR REGISTRATION ERROR

(71) Applicants: Norikazu Igarashi, Kanagawa (JP); Naruhiro Masui, Kanagawa (JP)

(72) Inventors: Norikazu Igarashi, Kanagawa (JP); Naruhiro Masui, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/101,504

(22) Filed: Dec. 10, 2013

(65) Prior Publication Data

US 2014/0169843 A1 Jun. 19, 2014

(30) Foreign Application Priority Data

Dec. 14, 2012 (JP) ..... 2012-274063
May 9, 2013 (JP) ..... 2013-099655

(51) Int. Cl.
*G03G 15/01* (2006.01)
*G03G 15/00* (2006.01)

(52) U.S. Cl.
CPC ..... *G03G 15/55* (2013.01); *G03G 15/5058* (2013.01); *G03G 2215/0129* (2013.01); *G03G 2215/0161* (2013.01)

(58) Field of Classification Search
CPC ..... G03G 2215/0161; G03G 15/0131; G03G 15/50; G03G 2215/0129; G03G 15/0194; G03G 15/238; G03G 2215/00021; G03G 15/5029; G03G 15/5058; G03G 15/5062; G03G 2215/00586; G03G 2215/00599; G03G 2215/00
See application file for complete search history.

(56) References Cited

U.S. PATENT DOCUMENTS

2011/0304886 A1* 12/2011 Hoover et al. ..... 358/1.18
2013/0064580 A1 3/2013 Igarashi et al.
2013/0148996 A1 6/2013 Masui

FOREIGN PATENT DOCUMENTS

JP 08-085236 4/1996
JP 4449524 4/2010
JP 2012-063499 3/2012
JP 2012-118166 6/2012

* cited by examiner

*Primary Examiner* — Roy Y Yi
(74) *Attorney, Agent, or Firm* — IPUSA, PLLC

(57) ABSTRACT

An image forming apparatus includes a color registration error amount calculation unit that calculates a color registration error amount from a first test pattern; a correction information obtaining unit that obtains a correction information for correcting an image on a back surface based on previously obtained contraction information of a printing paper after printing an image on a front surface when printing on both surfaces; and an image data correction unit that corrects the image on the back surface based on the color registration error amount calculated by the color registration error amount and the correction information obtained by the correction information obtaining unit.

12 Claims, 22 Drawing Sheets

IMAGE FORMING APPARATUS AND METHOD OF CORRECTING COLOR REGISTRATION ERROR

BACKGROUND OF THE INVENTION

1. Field of the Invention

The present invention relates to an image forming apparatus and a method of correcting a color registration error.

2. Description of the Related Art

Recently, for electrophotographic color image forming apparatuses, tandem color image forming apparatuses are mainly used, in which a plurality of image forming units are connected in series to form a full-color image. In the tandem image forming apparatuses, images formed by the plurality of image forming units corresponding to colors of yellow, cyan, magenta, black or the like, for example, are primarily transferred on an intermediate transfer belt in an overlapped manner. Then, the overlapped image is secondarily transferred on a printing paper, for example. Further, by fixing the secondarily transferred image on the printing paper, a full-color image is formed.

By the above described tandem image forming apparatuses, productivity (a number capable of being printed per hour, for example) is drastically increased. However, there may be misregistration of images of the plurality of colors due to inaccuracy of positions or differences in diameter of photosensitive drums, exposure equipment or the like, inaccuracy of optical systems, or the like, of the image forming units of the plurality of colors. This misregistration of images of the plurality of colors causes a color registration error in the image formed on the printing paper. Thus, correction of the color registration error is essential.

As the correction of the color registration error, a method is known in which test patterns for detecting color registration errors of the plurality of colors are formed on the intermediate transfer belt, positions of the test patterns are detected by a sensor or the like to calculate color registration error amounts, and, when forming a normal image, optical paths of the respective optical systems are corrected or starting positions to form the respective images or pixel clock frequencies are corrected based on the color registration error amounts.

However, in order to correct the optical path of the optical system, it is necessary to mechanically operate a light source, a correction optical system including an f-θ lens, a mirror in the optical path or the like for each color. Thus, it is necessary to provide a super precision movable member for each color to lead high-cost. Further, as it takes a large amount of time to complete such a correction, it is not easy to perform the correction operation often.

Conventionally, a method is known in which a coordinate position of image data of each color is automatically corrected in order to cancel misregistration by a coordinate converting unit based on a calculated color registration error amount of the respective color, for example (see Patent Document 1, for example). However, this method cannot correspond to a change of the color registration error amount over time due to a deformation of the optical system, the holding member or the like caused by a charge over time or a temperature change or the like in the image forming apparatus.

Thus, a method is known in which the correction of the color registration error is repeated in accordance with a predetermined temperature change or time (see Patent Document 2, for example).

Further, a method is known in which a test pattern is periodically at a position not overlapping with an area where a normal image is formed, and the color registration error amount is updated so that a correction can be performed based on a color registration error amount that corresponds to a temperature change or the like in the image forming apparatus (see Patent Document 3, for example).

Further, a color registration error factor includes a linear component that has linear characteristics regarding a distance in a main-scanning direction or in a sub-scanning direction, and a nonlinear component other than the linear component. The nonlinear component includes a color registration error of the nonlinear component, which is a so-called "bow of a scanning line of a main-scanning". A method is known in which a correction of high accuracy can be performed by using correction data of the nonlinear component (see Patent Document 4, for example).

However, according to the methods described in the Patent Document 1 and Patent Document 2, the color registration errors are not corrected in real time. Further, when images are printed on both surfaces of a printing paper, an image is printed on a back surface after printing an image on a front surface and passing the printing paper through a fixing device. At this time, water included in the printing paper is evaporated and the printing paper becomes a contracted state when passing through the fixing device. Thus, if the image is printed on the back surface when the printing paper is in the contracted state, there may cause misregistration or distortion in the image formed on the back surface when the size of the printing paper returns to its original size. However, the above described documents do not disclose measures for these problems.

Further, there may be a problem that an image is formed on a printing paper in inclined states when the printing paper is inclined with respect to a conveying direction of the printing paper. However, the above described documents do not disclose measures for this problem.

PATENT DOCUMENTS

[Patent Document 1] Japanese Laid-open Patent Publication No. H08-085236

[Patent Document 2] Japanese Patent No. 4449524

[Patent Document 3] Japanese Laid-open Patent Publication No. 2012-63499

[Patent Document 4] Japanese Laid-open Patent Publication No. 2012-118166

SUMMARY OF THE INVENTION

The present invention is made in light of the above problems, and provides an image forming apparatus capable of appropriately correcting an image to be formed.

According to an embodiment, there is provided an image forming apparatus including a color registration error amount calculation unit that calculates a color registration error amount from a first test pattern; a correction information obtaining unit that obtains a correction information for correcting an image on a back surface based on previously obtained contraction information of a printing paper after printing an image on a front surface when printing on both surfaces; and an image data correction unit that corrects the image on the back surface based on the color registration error amount calculated by the color registration error amount and the correction information obtained by the correction information obtaining unit.

According to another embodiment, there is provided an image forming apparatus including a tilt information storing unit that stores tilt information regarding a printing medium;

and an image forming unit that forms an image corrected based on the tilt information on an image forming area of a printing medium.

Note that also arbitrary combinations of the above-described elements, and any changes of expressions in the present invention, made among methods, devices, systems, recording media, computer programs and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
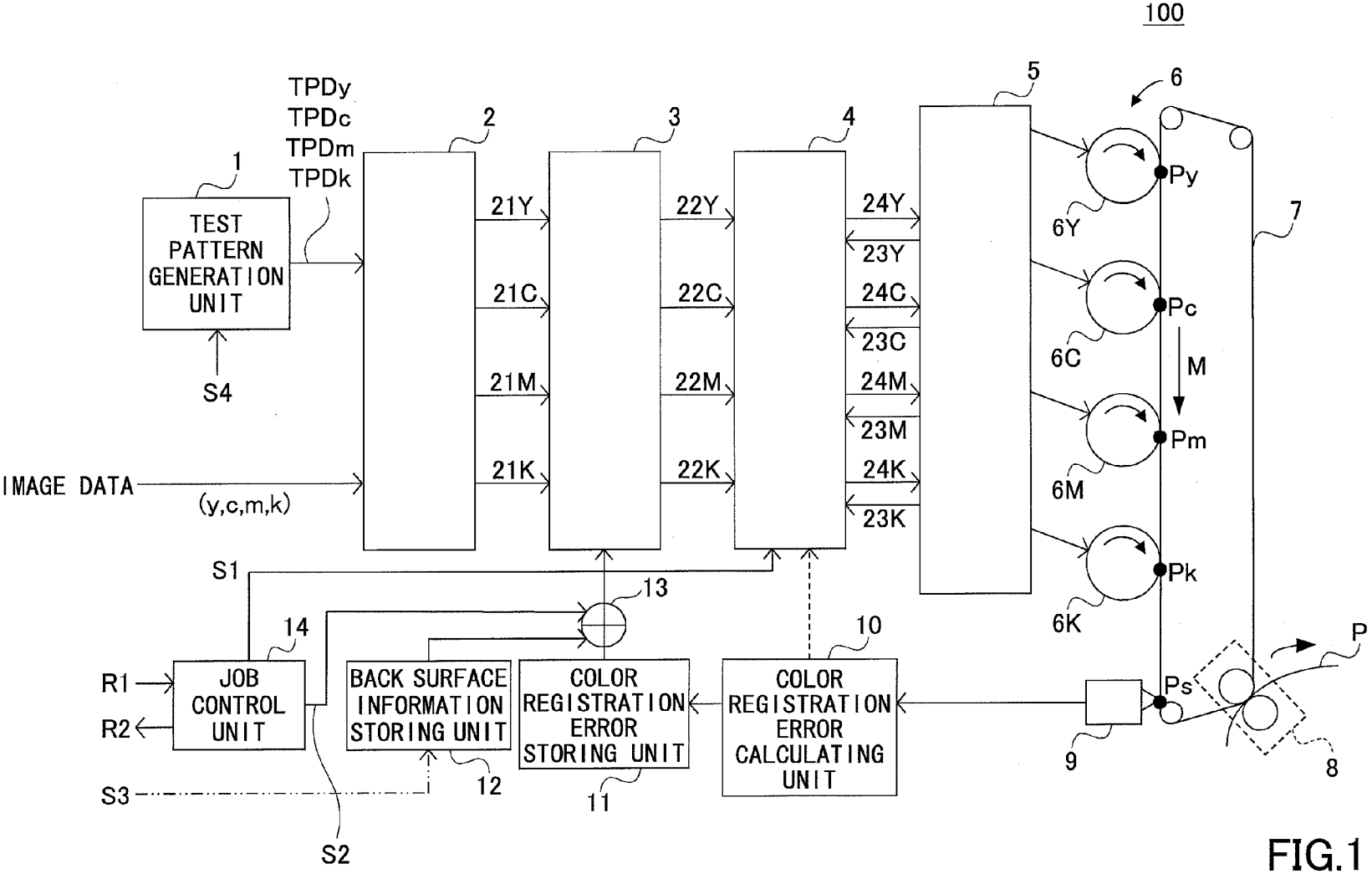
FIG. 1 is a block diagram for explaining an example of an overall structure of an image forming apparatus of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment (Overall Structure of Image Forming Apparatus: Block Diagram)

FIG. 1 is a block diagram for explaining an example of an overall structure of an image forming apparatus 100 of a first embodiment. The image forming apparatus 100 illustrated in FIG. 1 is a so-called tandem image forming apparatus that includes a plurality of image forming units corresponding to a plurality of colors. For example, the image forming apparatus 100 includes a plurality of photosensitive drums 6 corresponding to colors such as yellow (Y or y), cyan (C or c), magenta (M or m), black (K or k) and the like (hereinafter, marks in brackets indicate the colors).

As illustrated in FIG. 1, the image forming apparatus 100 includes a test pattern generation unit 1, an image path switching unit 2, an image data correction unit 3, a writing control unit 4, scanning optical systems 5, the photosensitive drums 6 (photosensitive drums 6Y, 6C, 6M and 6K), an intermediate transfer belt 7, a secondarily transfer unit 8, a test pattern detection unit 9, a color registration error calculating unit 10, a color registration error storing unit 11, a back surface information storing unit 12, an adding unit 13 and a job control unit 14.

The test pattern generation unit 1 generates, upon receiving a test pattern output instruction signal "S4", image data of a predetermined test pattern (hereinafter, referred to as "test pattern image data") and outputs it to the image path switching unit 2. Here, the predetermined test pattern is a test pattern for detecting color registration error (a first test pattern).

In this embodiment, the test pattern generation unit 1 generates different test pattern image data TPDy, TPDc, TPDm and TPDk (corresponding to colors Y, C, M, K, respectively) for the plurality of colors. Here, the test pattern image data TPDy, TPDc, TPDm and TPDk are used for detecting color registration error of an image formed on the intermediate transfer belt 7.

Image data for forming a normal image (hereinafter, referred to as "normal image data") y, c, m and k are also input to the image path switching unit 2. The image path switching unit 2 selects either of the normal image data y, c, m and k and the test pattern image data TPDy, TPDc, TPDm and TPDk and outputs the selected image data to the image data correction unit 3 as image data 21Y, 21C, 21M and 21K.

This means that the image data 21Y, 21C, 21M and 21K is either of the normal image data y, c, m and k and the test pattern image data TPDy, TPDc, TPDm and TPDk. The image path switching unit 2 may select either of the normal image data y, c, m and k and the test pattern image data TPDy, TPDc, TPDm and TPDk based on a switching signal (not illustrated in the drawings) sent from the job control unit 14, for example.

The image data correction unit 3 corrects the image data 21Y, 21C, 21M and 21K input from the image path switching unit 2 based on a current color registration error amount stored in the color registration error storing unit 11 to compensate the color registration error amount.

The image data correction unit 3 outputs image data 22Y, 22C, 22M and 22K whose color registration error amount is corrected, to the writing control unit 4.

Here, correction of the color registration error amount may be obtained for a front end of image data, for example, and the color registration error amount may be used for image data for a single sheet of printing paper (or a single set of test patterns).

Further, for example, when printing images on both surfaces, in other words, when forming an image on a back surface after printing an image on a front surface, the image data correction unit 3 corrects the image data 21Y, 21C, 21M and 21K based on the color registration error amount stored in the color registration error storing unit 11 and back surface information (correction information for correcting an image for a back surface) stored in the back surface information storing unit 12. Here, the back surface information is explained later in detail.

A method of correcting the color registration error amount by the image data correction unit 3 is explained later in detail.

A line synchronization signal 23Y, 23C, 23M or 23K of each color indicating that a light beam passes a predetermined position for the color is input to the writing control unit 4. Upon receiving the line synchronization signal 23Y, 23C, 23M or 23K, the writing control unit 4 generates a main-scanning synchronization signal for each color based on the line synchronization signal 23Y, 23C, 23M or 23K. Here, the main-scanning synchronization signal indicates a writing position in a main-scanning direction.

The writing control unit 4 also generates a sub-scanning synchronization signal for each color based on a job start instruction signal "S1" from the job control unit 14 or a writing start instruction from an engine controller unit (not illustrated in the drawings). The sub-scanning synchronization signal of each color is generated based on time differences between colors determined by the distance between photosensitive drums 6 (a distance between points "Py" and "Pc" on the intermediate transfer belt 7, for example) and a lineal speed of the intermediate transfer belt 7. Here, the sub-scanning synchronization signal indicates a writing position in a sub-scanning direction.

Further, the writing control unit 4 converts the image data 22Y, 22C, 22M and 22K input from the image data correction unit 3 to write signals 24Y, 24C, 24M and 24K that synchronize the main-scanning synchronization signals and the sub-scanning synchronization signals, respectively, based on a pixel clock generated inside. The write signals 24Y, 24C, 24M and 24K are modulating signals for light sources in the scanning optical systems 5, respectively. The writing control unit 4 outputs the write signals 24Y, 24C, 24M and 24K to the scanning optical systems 5, respectively.

The scanning optical systems 5 correspond to the photosensitive drums 6 (6Y, 6C, 6M and 6K), respectively. However, in FIG. 1, the scanning optical systems 5 are integrally illustrated. Each of the scanning optical systems 5 scans a light beam on the respective photosensitive drum 6 to form an electrostatic latent image on the photosensitive drum 6 and develops the electrostatic latent image by a developing device.

The images developed on the photosensitive drums 6 are primarily transferred on the intermediate transfer belt 7 at respective primarily transfer positions (Py, Pc, Pm and Pk) in an overlapped manner.

The secondarily transfer unit 8 secondarily transfers the image formed on the intermediate transfer belt 7 in an overlapped manner on a printing paper P at once. The image secondarily transferred on the printing paper P is fixed by a fixing device ("207" in FIG. 17, for example) so that a color image is formed. These operation timings are controlled by the engine controller unit (not illustrated in the drawings), for example.

As such, the corrected image data 22Y, 22C, 22M and 22K output from the image data correction unit 3 are developed on the photosensitive drums 6 of the respective colors and transferred on the intermediate transfer belt 7 in an overlapped manner.

The test pattern detection unit 9 is a reflection photo sensor or the like, for example, and reads the test pattern for detecting color registration error formed on the intermediate transfer belt 7. The test pattern detection unit 9 is controlled such that it reads (samples) the test pattern for detecting color registration error at a timing when the respective test pattern for detecting color registration error is at a reading position "Ps" in FIG. 1, for example.

The color registration error calculating unit 10 calculates a variation amount from an ideal value as a variation amount (value) of the color registration error amount based on a detected result of the test pattern for detecting color registration error obtained from the test pattern detection unit 9. Further, the color registration error calculating unit 10 calculates a new color registration error amount based on the calculated variation amount of the color registration error amount and the color registration error amount stored in the color registration error storing unit 11 (that is the last updated calculated color registration error amount). A method of calculating the variation amount of the color registration error amount is explained later The color registration error storing unit 11 stores the current color registration error amount for each color. When the new color registration error amount is calculated by the color registration error calculating unit 10, the color registration error storing unit 11 is updated to store the new color registration error amount instead of the previously stored color registration error amount. With this, even when the color registration error amount varies because of a temperature change or the like, for example, the color registration error amount at the moment can be always stored.

The back surface information storing unit 12 stores correction information (hereinafter, referred also to as "back surface information") for correcting an image to be printed on the back surface based on contraction information (variation information of position of image on the back surface) after printing on the front surface when printing on both surfaces, for example. The back surface information indicates contraction characteristics of the printing paper, and indicates a main-scanning magnification obtained for each predetermined numbers of lines in the sub-scanning direction on the back surface, a correction value of a main-scanning position, or the like, for example. The back surface information storing unit 12 also functions as a correction information obtaining unit that previously obtains the back surface information at an arbitrary timing such as when manufacturing the image forming apparatus 100, a timing of maintenance by a service man or a user, or the like.

Here, the back surface information may be obtained from, for example, a read result (a detected result) of a test pattern for detecting contraction characteristics (a second test pattern) of a printing paper that is previously formed at a predetermined position of the printing paper and read by an image reading device such as a scanner or the like, for example. As the back surface information varies depending on a condition of the printing paper such as a thickness, material or the like or a printing condition (fixing temperature for each image forming apparatus or the like, for example), for example, the back surface information may be obtained from results that are repeatedly obtained for a purposed printing paper or a purposed kind of an image forming apparatus.

When a data selection signal "S3" (expressed as a two-dot chain line) indicating to select the back surface information of a printing paper designated by a user is input, the back surface information storing unit 12 may output the back surface information of the printing paper corresponding to the data selection signal "S3" to the adding unit 13.

When a print surface instruction signal "S2" indicating to form an image on a back surface of the printing paper is input from the job control unit 14, the adding unit 13 adds the back surface information obtained from the back surface information storing unit 12 to the current color registration error amount stored in the color registration error storing unit 11.

Specifically, the adding unit 13 obtains a main-scanning magnification or a correction value of the main-scanning position of each sub-scanning line that forms an image on the back surface based on the main-scanning magnification or the correction value of the main-scanning position obtained from the back surface information storing unit 12. Further, the adding unit 13 adds the main-scanning magnification or the correction value of the main-scanning position obtained for each of the sub-scanning lines to the current color registration error amount stored in the color registration error storing unit 11 and outputs the added color registration error amount to the image data correction unit 3. A specific method of adding by the adding unit 13 is explained later.

The job control unit 14 issues the print surface instruction signal "S2" indicating a print surface of the printing paper in addition to control a timing of a print job. The print surface instruction signal "S2" may be an instruction signal to form an image on a back surface of the printing paper, as described above, or may be an instruction signal form an image on a front surface or a back surface of the printing paper.

For example, the job control unit 14 issues, in accordance with a request signal of printing an image "R1", the job start instruction signal "S1" and outputs it to the writing control unit 4. In addition, the job control unit 14 issues the print surface instruction signal "S2" and outputs it to the adding unit 13. Here, the "job" or the "print job" means a process to form a single image or a set of a test pattern for detecting color registration error on the intermediate transfer belt 7, for example.

When the print job is to form the test pattern for detecting color registration error, the job control unit 14 may issue a job start instruction signal "S1" in which the print job to form the test pattern for detecting color registration error is inserted between the print jobs to form normal images. Further, when the print job is to form the test pattern for detecting color registration error, the job control unit 14 may issue the test pattern output instruction signal "S4" and outputs it to the test pattern generation unit 1.

On the other hand, when the print job is to form a normal image, the job control unit 14 issues a request signal of transferring image data "R2".

The job start instruction signal "S1" is output to the writing control unit 4 and the engine controller unit (not illustrated in the drawings), and timings of units of the image forming apparatus 100 are controlled by the job start instruction signal "S1".

Here, the writing control unit 4 controls to output the write signals 24Y, 24C, 24M and 24K, for a single print job, at different timings to the respective scanning optical systems 5 in accordance with the distances between the photosensitive drums 6 of the plurality of colors. Thus, in order to reduce a buffer memory of the writing control unit 4, the image data and the test pattern for detecting color registration error may be output at different timings for each color.

In other words, the writing control unit 4 may output an output instruction signal for the test pattern for detecting color registration error of each color to the test pattern generation unit 1 and may issue the request signal of transferring image data "R2" for each color, based on the sub-scanning synchronization signal. Alternatively, the writing control unit 4 may output the sub-scanning synchronization signal to the job control unit 14 so that the job control unit 14 generates the test pattern output instruction signal "S4" and the request signal of transferring image data "R2" for each color.

(Print Job Timing of Test Pattern for Detecting Color Registration Error)

Figure 2:
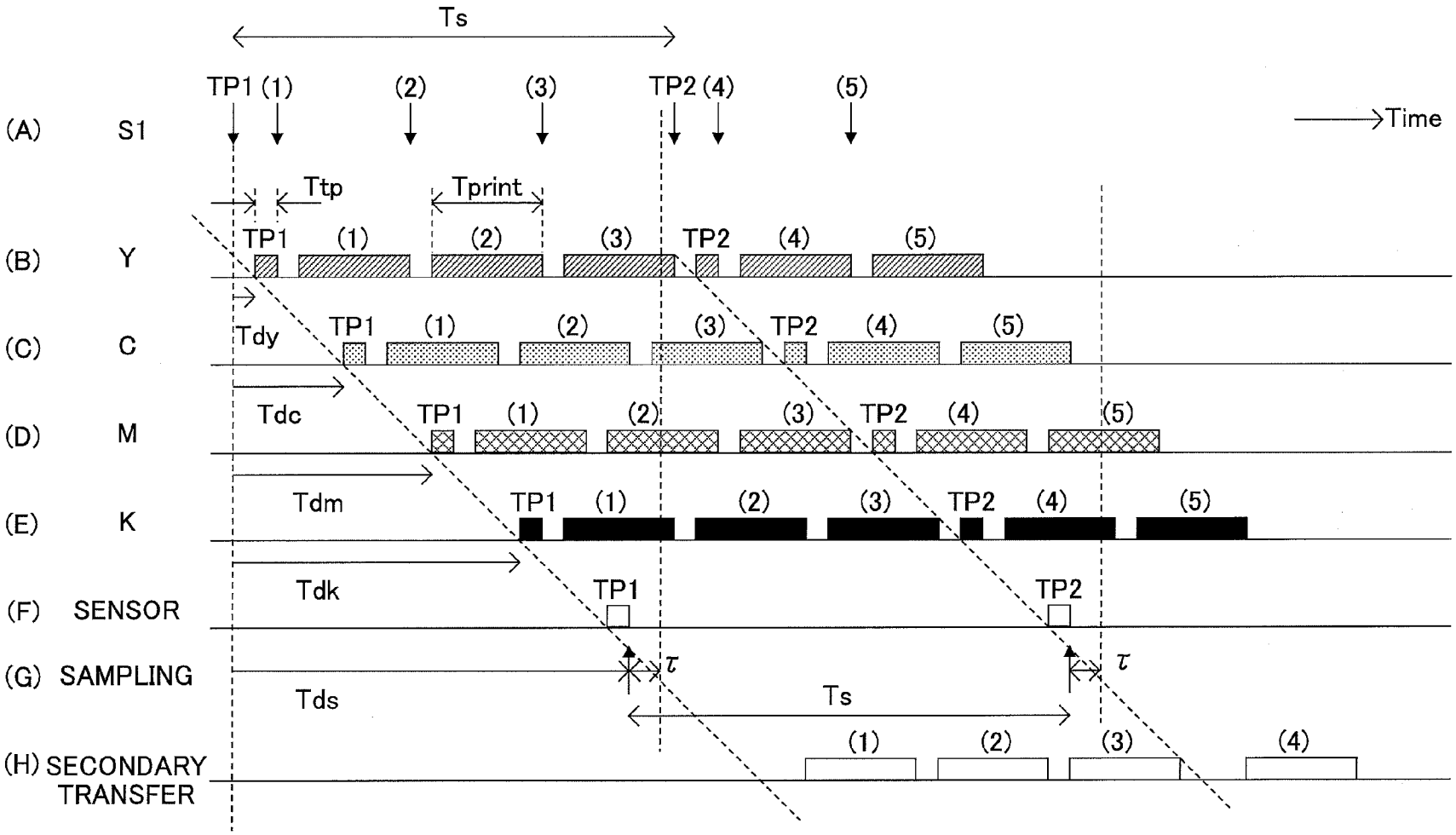
FIG. 2 is a view illustrating an example of a timing chart for explaining print job timing.

FIG. 2 is a view illustrating an example of a timing chart for explaining the print job timing. FIG. 2 illustrates an example in which a print job "TP" to form a test pattern for detecting color registration error is performed every three normal images are formed. Numerals (1) to (5) illustrated in FIG. 2 indicate the number of the normal images.

In FIG. 2, (A) indicates a timing of job start instruction signals "S1" ("TP1" and "TP2" for the test patterns for detecting the color registration error, respectively, and (1) to (5) for the normal images). Arrows illustrated in (A) indicate a start timing of a respective job start instruction signal "S1".

In FIG. 2, (B) to (E) indicate print job timings of the plurality of colors (Y, C, M and K) at the points (primarily transfer positions "Py", "Pc", "Pm" and "Pk" illustrated in FIG. 1) on the intermediate transfer belt 7, respectively.

For example, (B) indicates a print job timing at which images developed on the photosensitive drum 6Y are transferred to the intermediate transfer belt 7 at the primarily transfer position "Py". Here, the transferring timing of the test pattern for detecting the color registration error (TP1) is delayed for a delay time "Tdy" from the job start instruction signal "S1" due to process and delay time caused at units or the like, for example. Similarly, for other test patterns or images, the transferring timings at the photosensitive drum 6Y are delayed for the same delay time "Tdy" from the respective job start instruction signal "S1".

Similarly, (C) indicates a print job timing at which images developed on the photosensitive drum 6C are transferred to the intermediate transfer belt 7 at the primarily transfer position "Pc". Here, the transferring timing of the test pattern for detecting the color registration error (TP1) is delayed for a delay time "Tdc" from the job start instruction signal "S1". The delay time "Tdc" is obtained by adding a time difference determined by a distance between the primarily transfer position "Py" and the primarily transfer position "Pc" and a lineal speed of the intermediate transfer belt 7, to the delay time "Tdy".

Similarly, (D) indicates a print job timing at which images developed on the photosensitive drum 6M are transferred to the intermediate transfer belt 7 at the primarily transfer position "Pm" and (E) indicates a print job timing at which images developed on the photosensitive drum 6K are transferred to the intermediate transfer belt 7 at the primarily transfer position "Pk".

(F) indicates a passing timing at which the test patterns for detecting color registration error pass the reading position "Ps" of the test pattern detection unit 9. The passing timing of the test patterns for detecting color registration error from the job start instruction signal "S1" is determined in accordance with a distance between the primarily transfer position "Py and the reading position "Ps". The test pattern detection unit 9 may be configured such that it is only operated at a period near the passing timing of the test pattern for detecting color registration error. With this configuration, an error in detection can be prevented and energy can be saved.

Further, (G) indicates a timing at which the detection of the test patterns for detecting color registration error by the test pattern detection unit 9 is completed and corresponds to sampling points of the color registration error amounts. A delay time "Tds" from the from the job start instruction signal "S1" is obtained by adding a time difference determined by a total distance of a distance between the primarily transfer position "Py" and the reading position "Ps" and a length of the test pattern for detecting color registration error and the lineal speed of the intermediate transfer belt 7, to the delay time "Tdy". Here, after a calculation period "τ" of the color registration error amount, the color registration error amount is updated by a new color registration error amount.

Thus, for a print job (from "TP2") issued after the calculation period "τ" of the color registration error amount illustrated in (G), the new updated color registration error amount is referred to for each color.

It means that a period obtained by adding the calculation period "τ" of the color registration error amount to the delay time "Tds" is necessary for updating the color registration error amount from the print job start timing of the test pattern for detecting color registration error. As the color registration error amount is not updated during this period, this period (the delay time "Tds"+the calculation period "τ") is a waste period for a control system that controls the color registration error amount stored in the color registration error storing unit 11 to be always updated at the current color registration error amount.

Further, a period "Ts" between the print jobs of the test patterns for detecting color registration error is a sampling period for a control system and the sampling period "Ts" is set to be more than or equal to the wasted period (the delay time "Tds"+the calculation period "τ"). A main reason for the change of the color registration error amount is the temperature change and this change occurs relatively slow, for example, during a few minutes.

Thus, the sampling period "Ts" may be set to be sufficiently shorter than a few minutes. For example, when the sampling period "Ts" is set to be a few seconds, for the image forming apparatus capable of printing 60 papers per minute, the test pattern for detecting color registration error is formed every few papers. FIG. 2 illustrates an example where the test pattern for detecting color registration error is inserted every three papers. The timing of the sampling is unnecessarily too precise.

In FIG. 2, (H) illustrates a print job timing at which normal images (1) to (4) are transferred on the printing paper at the secondarily transfer unit 8. Here, for the test pattern for detecting color registration error, the transfer belt of the secondarily transfer unit 8 is positioned apart from the intermediate transfer belt 7 so that the test pattern for detecting color registration error is not transferred on the printing paper.

(Forming Area for Test Pattern for Detecting Color Registration Error)

Figure 3:
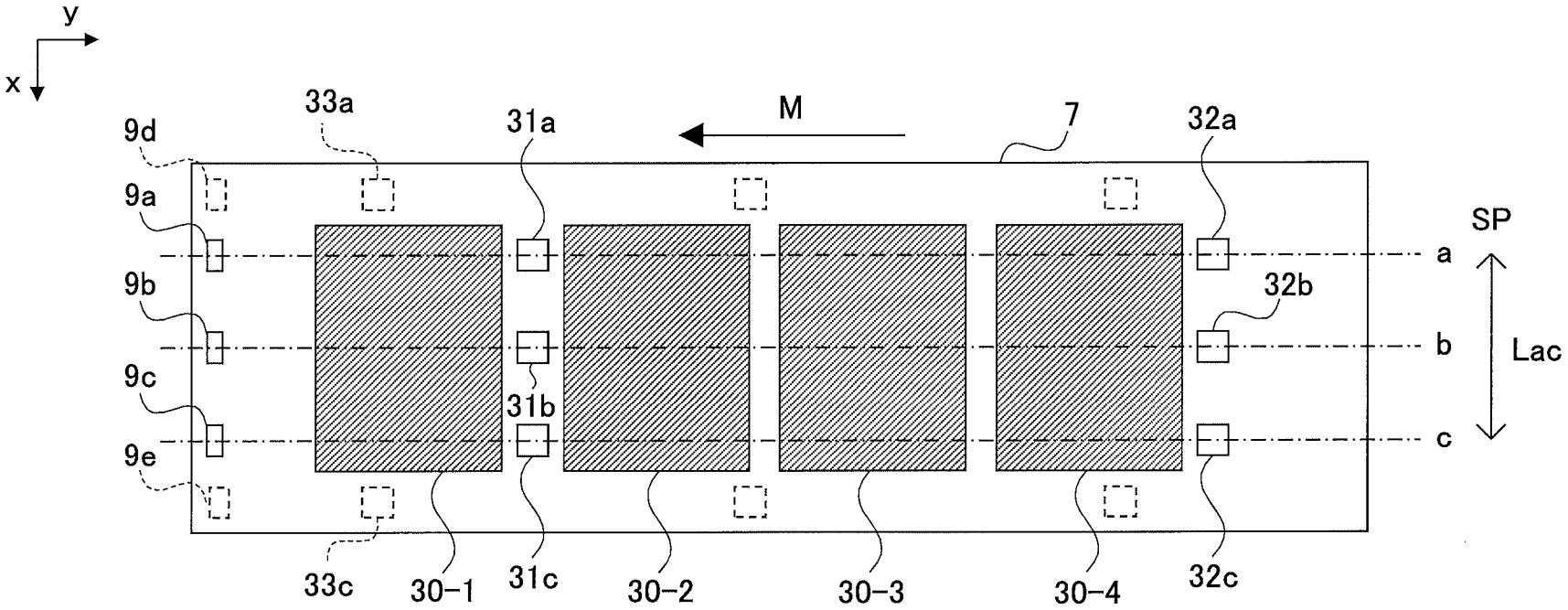
FIG. 3 is a view illustrating an example of a forming area of a test pattern for detecting color registration error.

FIG. 3 is a view illustrating an example of a forming area of the test pattern for detecting color registration error. FIG. 3 is a top view of the intermediate transfer belt 7 seen in a vertical direction. In FIG. 3, it is assumed that a direction perpendicular to the longitudinal direction of the intermediate transfer belt 7 is the main-scanning direction (an x-axis direction) while a moving direction "M" of the intermediate transfer belt 7 is the sub-scanning direction (negative direction of a y-axis direction), when forming an image. Here, for example, the test pattern detection unit 9 includes three detection units 9*a*, 9*b* and 9*c* that are aligned in the main-scanning direction "x".

It is assumed that image forming areas 30-1 to 30-4, hatched areas in FIG. 3, correspond to (1) to (3) of the job start instruction signal "S1" illustrated in FIG. 2, respectively. There are provided test pattern forming areas 31*a*, 31*b* and 31*c* for forming the test patterns for detecting color registration error, respectively, between the adjacent image forming areas (between 30-1 and 30-2) in the sub-scanning direction "y" (or in the moving direction "M") (in other words, between printing papers).

Further, there are provided next test pattern forming areas 32*a*, 32*b*, 32*c* at a rear area of the image forming area 30-4 in the moving direction "M" with a predetermined interval from the test pattern forming areas 31*a*, 31*b* and 31*c*. The test patterns for detecting color registration error are formed in accordance with the timings of "TP1" and "TP2" illustrated in FIG. 2, for example. The interval between the test pattern forming areas may not be strictly the same distance and the print job may be controlled such that the test pattern forming areas are inserted between papers.

Figure 4:
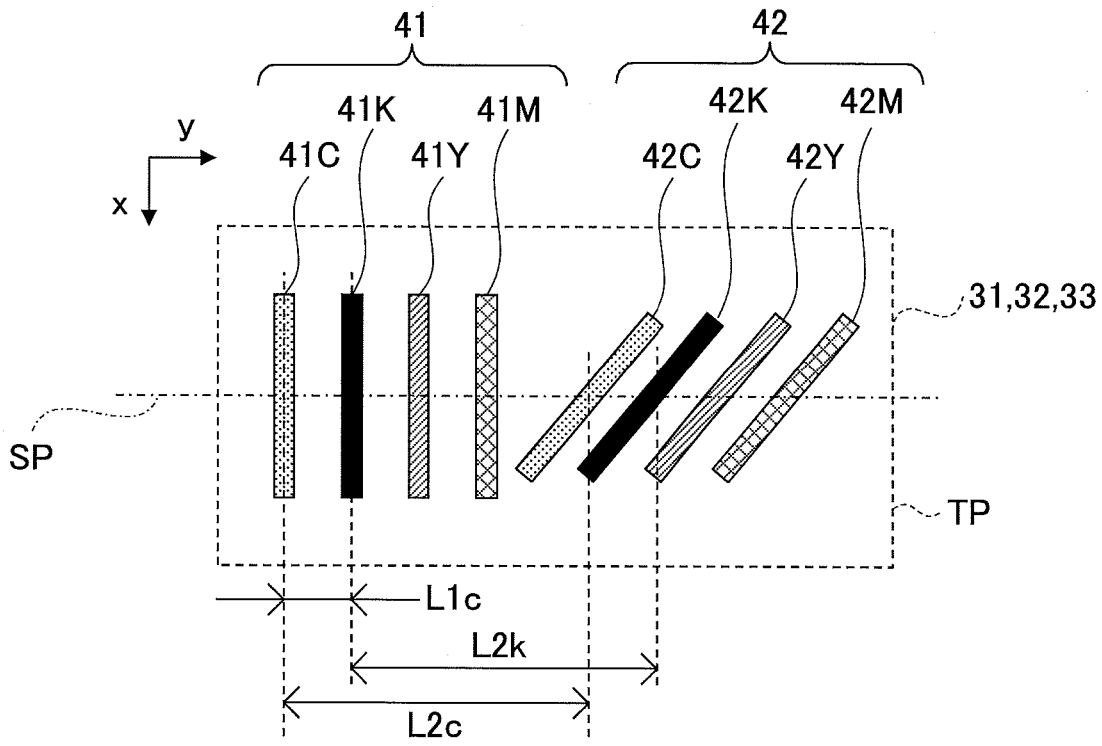
FIG. 4 is a view illustrating an example of a structure of a test pattern for detecting color registration error.

Positions of the test pattern forming areas 31*a*, 31*b* and 31*c* and the test pattern forming areas 32*a*, 32*b* and 32*c* correspond to the detection units 9*a* to 9*c* of the test pattern detection unit 9 on dashed lines a, b and c, respectively, in the main-scanning direction "x", for example. In FIG. 4, numerals "31", "32" and "33" represent 31*a* to 31*c*, 32*a* to 32*c* and 33*a* and 33*b*, in FIG. 3, respectively.

The test patterns for detecting color registration error may be formed at any places on the intermediate transfer belt 7 except the image forming areas, and may be formed at both ends of the intermediate transfer belt 7 in the main-scanning direction "x" as indicated by numerals "33*a*" and "33*c*". At this time, the test pattern detection unit 9 may include detection units 9*d* and 9*e*. With this, the test patterns for detecting color registration error can be placed at the same position as the normal image in the sub-scanning direction "y" and it is unnecessary to control the test patterns for detecting color registration error to be exclusively positioned with the normal image in the sub-scanning direction "y". Further, as it is unnecessary to form the test patterns between the print jobs of the normal images or between the papers, an interval between the positions of the test pattern can be arbitrarily selected.

(Example of Structure of Test Pattern for Detecting Color Registration Error)

FIG. 4 is a view illustrating an example of a structure of the test pattern for detecting color registration error. Similar to FIG. 3, the x-axis expresses the main-scanning direction and the y-axis expresses the sub-scanning direction in FIG. 4. As illustrated in FIG. 4, the test pattern for detecting color registration error (a first test pattern) includes a parallel line set 41 and an oblique line set 42. The parallel line set 41 includes a parallel line that is extending parallel to the main-scanning direction "x" while the oblique line set 42 includes an oblique line that forms a 45° angle with respect to the main-scanning direction "x" for each color. Specifically, in this embodiment, the parallel line set 41 includes parallel line patterns 41C, 41K, 41Y and 41M that are extending parallel to the main-scanning direction "x" and the oblique line set 42 includes oblique line patterns 42C, 42K, 42Y and 42M that are forming a 45° angle with respect to the main-scanning direction "x" in pair. These patterns are aligned in order of colors (in order of C, K, Y and M, for example, in FIG. 4) in the sub-scanning direction "y".

The test pattern for detecting color registration error (surrounded by a dotted line) may be formed at plural positions (three, as the test pattern forming areas 31*a* to 31*c* or 32*a* to 32*c* illustrated in FIG. 3) on the intermediate transfer belt 7 in the main-scanning direction "x" and may be used as a set of the test patterns for detecting color registration error.

(Structure of Test Pattern Detection Unit 9)

Figure 5:
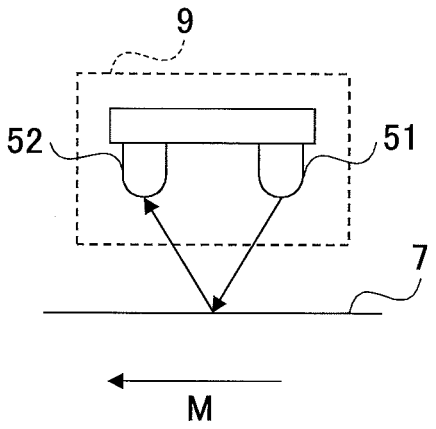
FIG. 5 is a view illustrating an example of a structure of a test pattern detection unit.

FIG. 5 is a view for explaining an example of a structure of the test pattern detection unit 9. As illustrated in FIG. 5, the test pattern detection unit 9 is a reflection photo sensor or the like, for example. The test pattern detection unit 9 includes a pair of a light emitting unit 51 and a light receiving unit 52. The test pattern detection unit 9 is configured such that the light emitting unit 51 emits a light toward the intermediate transfer belt 7, the light receiving unit 52 receives a reflected light reflected from the intermediate transfer belt 7 and the received light is converted to an electric signal.

For example, when the test pattern is not formed on the intermediate transfer belt 7 (without toner), the amount of the reflected light becomes strong while when the test pattern is formed on the intermediate transfer belt 7 (with toner), as the emitted light scatters, the amount of the reflected light received by the light receiving unit 52 is decreased.

Thus, by previously setting a threshold value for the amount of reflected light, for example, whether the test pattern for detecting color registration error is formed on the intermediate transfer belt 7 can be detected.

For example, the color registration error calculating unit 10 includes an A/D converter or the like that performs a sampling at a constant period, and performs a signal processing by converting the electric signal (sensor output signal) obtained from the light receiving unit 52 by the A/D converter or the like.

With this, time when the center position of each of the test patterns (parallel line patterns 41 or the like, for example) formed on the intermediate transfer belt 7 passes a sensor position "SP" (a position of the test pattern detection unit 9) is obtained. Further, distances between the center positions of the test patterns can be measured from the time when each of the test patterns passes and the lineal speed of the intermediate transfer belt 7.

(Contracted State of Back Surface after Printing Image on Front Surface)

Figure 6:
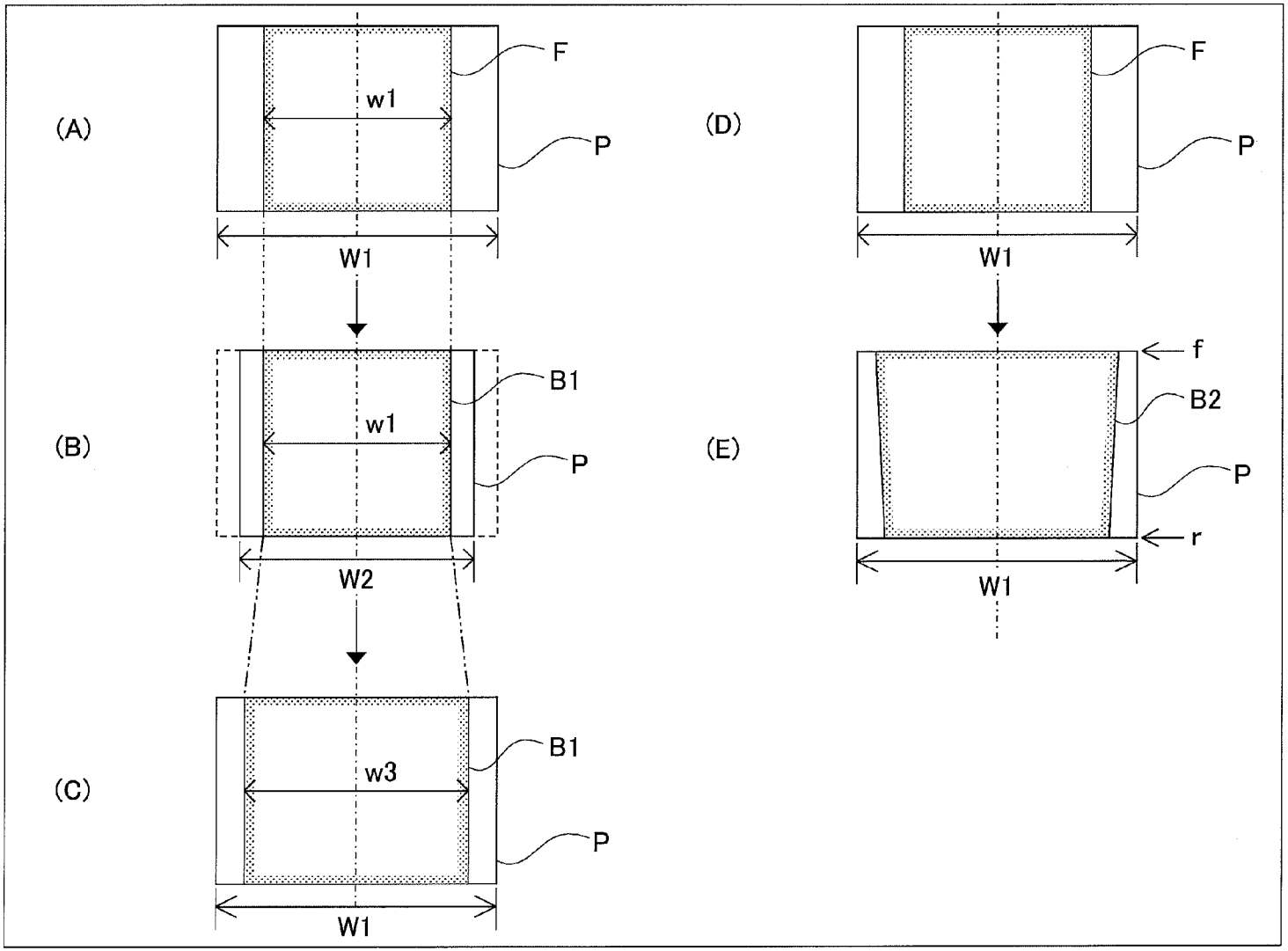
FIG. 6 is a view for explaining a contracted state after printing an image on a front surface.

FIG. 6 is a view for explaining a contracted state after printing an image on a front surface. In FIG. 6, (A) to (C) are views for explaining misregistration between images formed on the front surface and the back surface.

In (A), an image area "F" of the front surface of the printing paper P at which an output image is formed is illustrated. At this time, the printing paper P has a width "W1" and the image area F has a width "w1".

Then, when the printing paper P passes through the fixing device of the image forming apparatus 100, water included in the printing paper P is evaporated and a water content in the printing paper P varies.

Thus, as illustrated in (B), the printing paper P becomes a contracted state to have a width "W2" that is smaller than the width "W1". Then, an image is formed (transferred) on an image area "B1" of the back surface at a center position of the printing paper P at the contracted state. At this time, although the printing paper P has the width "W2", the image area B1 has the width "w1".

Thereafter, as illustrated in (C), the printing paper P is enlarged (returned to its original size) to have the width "W1" by absorbing moisture in accordance with a peripheral environment of the like. At this time, the image area B1 of the back surface of the printing paper P becomes enlarged to have a width "w3", which is wider than the width "w1", in accordance with the variation of the size of the printing paper P. Thus, the width "W1" of the printing paper P illustrated in (C) is larger than the width "W2" of the printing paper P illustrated in (B) and the with "w3" of the image area "B1" of the back surface illustrated in (C) is larger than the width "w1" of the image area "F" of the front surface illustrated in (A).

Therefore, misregistration occurs between the image formed on the front surface and the image formed on the back surface.

Further, when the temperature of the fixing device varies, in other words, when the fixing temperature is different depending on areas on the printing paper P that passes through the fixing device, there is a temperature distribution on the printing paper P.

In FIGS. 6, (D) and (E) are views for explaining distortion of the image generated due to a temperature distribution when passing through the fixing device.

For example, when the temperature is high at a front end portion "f" of the printing paper P and the temperature is low at a rear end portion "r" of the printing paper P, contracted states at the front end portion "f" and the rear end portion "r" of the printing paper P are different. Specifically, the printing paper P is contracted more at the front end portion "f" than at the rear end portion "r". Thus, when the size of the printing paper P returns to its original size, widths of image areas "B2" at the front end portion "f" and the rear end portion "r" are different. Specifically, the width of the image area "B2" at the front end portion "f" becomes wider than that at the rear end portion "r". Thus the image area "B2" of the back surface becomes trapezoid compared with the image area "F" of the front surface.

As described above, when printing an image on the back surface after printing an image on the front surface, the image is formed on the back surface after passing through the fixing device. Thus, misregistration or distortion of the image occurs on the image formed on the back surface in accordance with a contraction of the printing paper P. Thus, in this embodiment, by previously obtaining contraction information (variation information of position of image on the back surface due to the contraction), the above described misregistration or the distortion of the image when forming the image on the back surface can be corrected.

(Example of Test Pattern that is Printed to Obtain Back Surface Information)

Figure 7B:
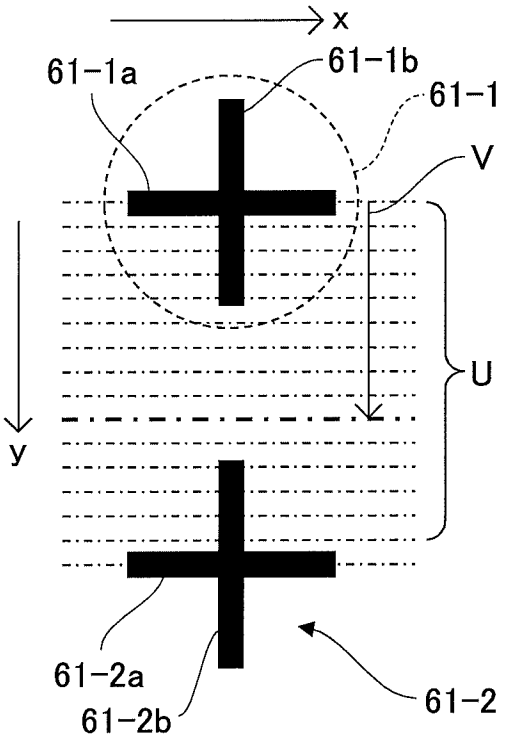
FIG. 7A and FIG. 7B are views illustrating an example of a test pattern that is printed for obtaining back surface information.
Figure 7A:
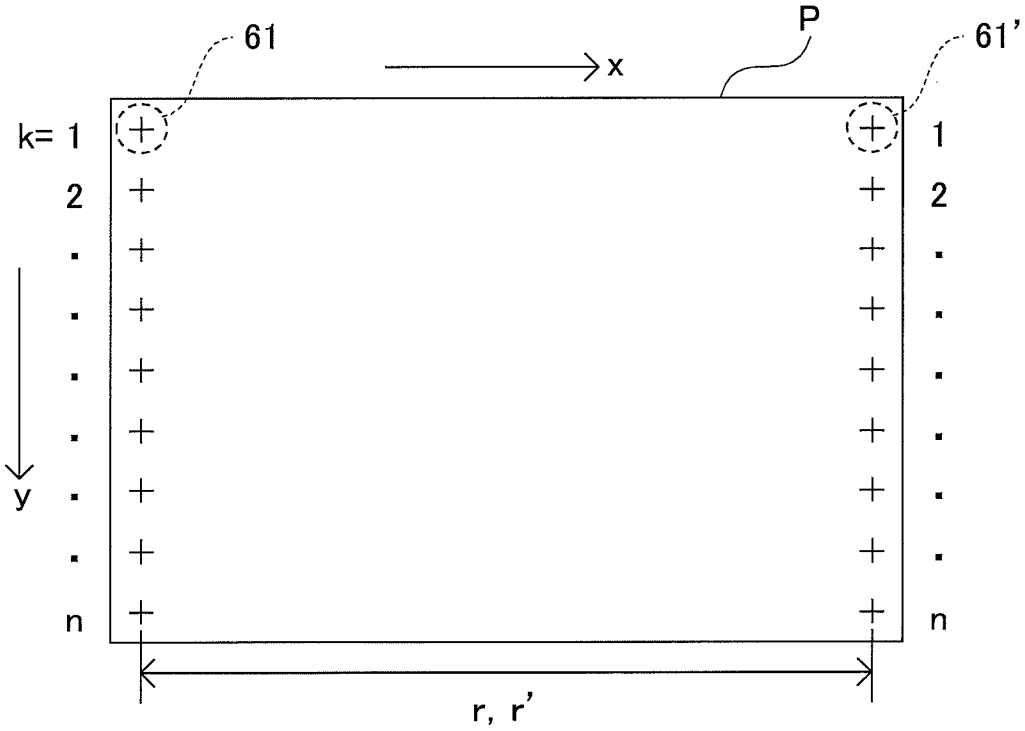

FIG. 7A and FIG. 7B are views illustrating an example of the test pattern that is printed for obtaining the back surface information. FIG. 7A is a view illustrating an example of positions of test patterns for detecting contraction characteristics of a printing paper formed on the printing paper P. FIG. 7B is an enlarged view of the test patterns illustrated in FIG. 7A. The conveying direction of the printing paper P is the sub-scanning direction "y" and a direction perpendicular to the conveying direction is the main-scanning direction "x", in FIG. 7A and FIG. 7B.

For the example illustrated in FIG. 7A, a plurality of test patterns 61 and 61' (second test patterns) each having cruciform, for example, are aligned at both ends of the printing paper P in the sub-scanning direction "y" from k=1 to n with a same interval. The test patterns 61 and 61' may be formed in any color selected from yellow (Y), cyan (C), magenta (M) and black (K).

As illustrated in FIG. 7B, the test pattern 61-1 (one of the test patterns 61) includes a parallel pattern 61-1*a* that is extending in a parallel direction of the main-scanning direction "x" and a vertical pattern 61-1*b* that is extending in a vertical direction of the main-scanning direction "x". The test pattern 61-1 and the test pattern 61-2 (one of the test patterns 61), that are positioned at the same position in the main-scanning direction "x", are provided to have a predetermined space.

Specifically, the test pattern 61-1 and the test pattern 61-2 are provided such that a space between the parallel pattern 61-1*a* of the test pattern 61-1 and the parallel pattern 61-2*a* of the test pattern 61-2 has the numbers of lines "U", for example.

Here, predetermined lines between the parallel pattern 61-1*a* of the test pattern 61-1 to vertical pattern 61-2*b* of the test pattern 61-2 are set as lines to be corrected (correction unit lines "V").

In this embodiment, the test patterns 61 and 61' formed at the both surfaces of the printing paper P are read by an image forming apparatus such as a scanner or the like. Then, a distance "rn" between the test patterns 61 and 61' formed at the same sub-scanning position (k=n) is obtained for each pair at the front surface of the printing paper P. Similarly, a distance "r'n" between the test patterns 61 and 61' formed at the same sub-scanning position (k=n) is obtained for each pair at the back surface of the printing paper P. For example, a distance "r1" between the test patterns 61 and 61' formed at the sub-scanning position k=1 (see FIG. 7A) at the front surface is obtained. Similarly, a distance "r'1" between the test patterns 61 and 61' formed at the sub-scanning position k=1 (see FIG. 7A) at the back surface is obtained.

As such, the distances "rn" corresponding to the sub-scanning positions (k=1, 2, 3 . . . n) of the front surface are obtained, and then, the distances "r'n" corresponding to the sub-scanning positions (k=1, 2, 3 . . . n) of the back surface are obtained. Then, using the obtained distances "rn" and the "r'n", for each of the sub-scanning positions (k=1, 2, 3 . . . n), a main-scanning magnification "P" is obtained based on the following equation 1.

$$P1=r1'/r1$$

$$P2=r2'/r2$$

$$Pn=rn'/rn \quad (1)$$

Further, as described above, an image is formed on the printing paper P such that its center position matches the center position of the printing paper P. Thus, a correction value "Q" of the main-scanning position for correcting the main-scanning position of the image is calculated based on the main-scanning magnification "P". The correction value "Q" of the main-scanning position is calculated based on the following equation 2, for each of the sub-scanning positions (k=1, 2, 3 . . . n).

$$Q1=((P1^{-1}-1)\cdot r1/2)\cdot\kappa$$

$$Q2=((P2^{-1}-1)\cdot r2/2)\cdot\kappa$$

$$Qn=((Pn^{-1}-1)\cdot rn/2)\cdot\kappa \quad (2)$$

Here, "κ" is a coefficient for converting a unit of the distance from "mm" to "dot". For image data of 1200 dpi, κ=1200/25.4. Also, "·" expresses multiply.

Figure 8B:
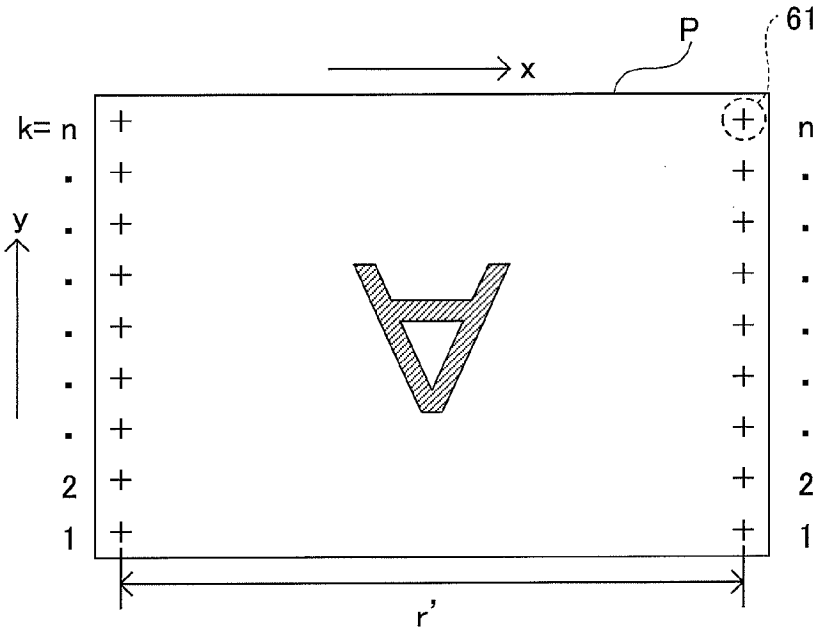
FIG. 8A and FIG. 8B are views illustrating an example of a test pattern to be printed on a front surface or a back surface of a printing paper.
Figure 8A:
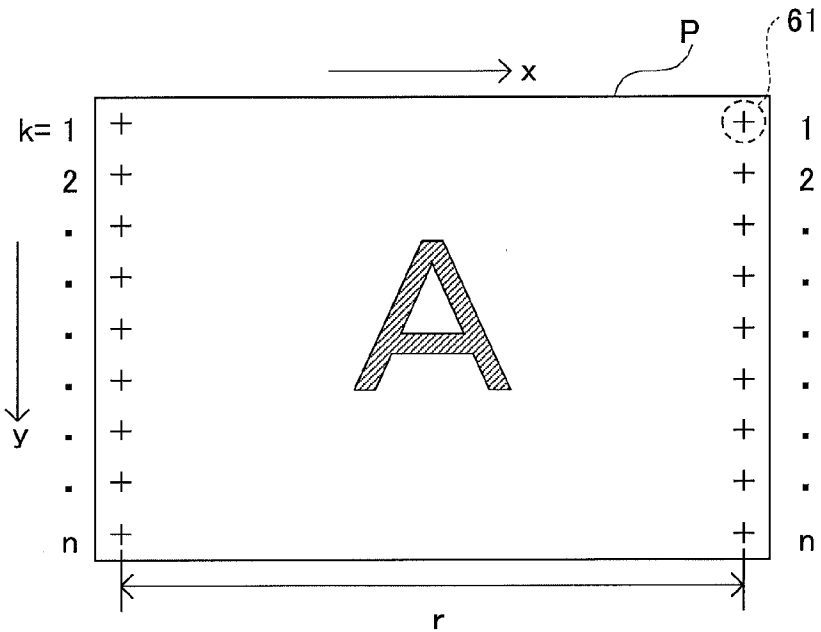

FIG. 8A and FIG. 8B are views illustrating an example of the test pattern to be printed on the front surface or the back surface of the printing paper P. FIG. 8A is a view illustrating an example of the test pattern formed on the front surface of the printing paper P and FIG. 8B is a view illustrating an example of the test pattern formed on the back surface of the printing paper P.

By comparing the image "A" illustrated in FIG. 8A and the image "A" illustrated in FIG. 8B, directions of the image "A" are different in the sub-scanning direction "y" with respect to the main-scanning direction "x". In such a case, the main-scanning magnification "P" or the correction value "Q" of the main-scanning position may be calculated using the distance "rn" and the distance "r'n" obtained of the front surface and the back surface, respectively, at the same sub-scanning position (k=1, 2, 3 . . . n).

Here, the shapes of the test patterns 61 and 61' are not limited to cruciform as illustrated in FIG. 7A or the like, and may be any shape provided that the distances "r" and "r'" for each of the sub-scanning positions can be obtained.

Further, the test patterns 61 and 61' may be read by the scanner or the like after the printing paper P on both surfaces of which the test patterns 61 and 61' are formed is held to be adapted to a peripheral environment and the size of the printing paper P is returned to its original size from the contracted state. With this, a detection error can be reduced that is caused by the difference in various conditions such as the peripheral environment, held time or the like when reading the images formed on both surfaces of the printing paper P.

As described above, the back surface information storing unit 12 may previously store the above described line number "U" or the like between the test patterns 61, in addition to the main-scanning magnification "P" and the correction value "Q" of the main-scanning position obtained for each of the sub-scanning positions (k=1, 2, 3 . . . n), as the back surface information.

Further, for cases when there is little difference between the values of the main-scanning magnification "P" in the sub-scanning direction or when there is a noise in the value of the main-scanning magnification "P", a value obtained by smoothing calculated results of the sub-scanning positions (k=1 to n) may be stored as the value of the main-scanning magnification "P" in the back surface information storing unit 12. Further, in order to reduce an error, the test pattern may be printed on a plurality of printing papers P, calculated results of the plurality of printing papers P may be obtained, and a value obtained by smoothing the calculated results may be stored as the value of the main-scanning magnification "P" in the back surface information storing unit 12.

Further, when the values of the main-scanning magnification "P" linearly vary from a front end (sub-scanning position k=1) to a rear end (sub-scanning position k=n) of the printing paper P, only the calculated result of the front end and the rear end may be stored in the back surface information storing unit 12. On the other hand, when the values of the main-scanning magnification "P" nonlinearly vary from the front end to the rear end of the printing paper P, all of the calculated results may be stored in the back surface information storing unit 12.

Further, if the main-scanning magnification "P" and the correction value "Q" of the main-scanning position vary in the sub-scanning direction when forming the image on the back surface, as will be described later, the main-scanning magnification "P" and the correction value "Q" of the main-scanning position may be calculated for each correction unit lines "V" and the correction may be performed for each correction unit lines "V".

Further, when the condition at printing an image on the back surface varies due to a variance in a condition (kind, thickness, size or the like, for example) of the printing paper P, or a structure or an environment of the image forming apparatus (set temperature for fixing, conveying path for a paper or the like, for example), the contracted state of the printing paper P may vary. Thus, the main-scanning magnifications "P" and the correction values "Q" of the main-scanning position corresponding to various assumable conditions of a printing environment (various conditions of the printing paper P, various kinds of image forming apparatuses, or the like) may be obtained as the back surface information. With this structure, it is possible to correspond to a variation of the contracted state of the printing paper P. Further, when a printing paper that is not previously assumed is used or the like, the main-scanning magnification "P" and the correction value "Q" of the main-scanning position may be newly obtained and used as the back surface information.

(Another Method of Obtaining Back Surface Information)

According to the above described method of obtaining the back surface information, as a measurement error occurs in the back surface information if the various conditions for providing the printing paper P on both surfaces of which the test patterns 61 and 61' are printed to an image reading device are not the same. Thus, an example is explained above in which the test patterns 61 and 61' are read by the scanner or the like after the printing paper P is held to be adapted to a peripheral environment and the size of the printing paper P is returned to its original size from the contracted state. However, this method requires a time to hold the printing paper P to be returned to its original size.

Thus, as another method of obtaining the back surface information, for example, the test patterns 61 and 61' may be formed on the printing paper P and the test patterns 61 and 61' may be read, using an image forming apparatus to which an image reading device such as a scanner or the like, for example, is connected, at the contracted state by a heat of the fixing device.

For example, the test patterns 61 and 61' are printed only on the front surface of the printing paper P, and the patterns 61 and 61' of the front surface are read by the image reading device under a state where the printing paper P is at the contracted state by a heat of the fixing device to obtain the distances "rn". Then, the main-scanning magnification "P" and the correction value "Q" of the main-scanning position for each of the sub-scanning positions may be obtained based on the distances "rn" and set distances "r'n" (ideal value, set value) that are previously set when forming the test patterns 61 and 617 on the front surface.

According to the above described method, the held time to have the printing paper P adapted to the peripheral environment is unnecessary and by setting the period from printing on the printing paper P to reading by the image reading device constant, the various conditions can be made the same and the accuracy of the back surface information can be improved.

(Method of Calculating Color Registration Error Amount)

Next, a method of calculating the color registration error amount from a detected result of the test pattern for detecting color registration error illustrated in FIG. 4 is explained. The main components of the color registration error are skew, registration displacement (also referred to as "margin displacement" or "offset displacement") in the sub-scanning direction, a magnification error in the main-scanning direction, registration displacement in the main-scanning direction or the like.

Here, as the method of calculating the color registration error amount from the test pattern for detecting color registration error, a method disclosed in Japanese Patent No. 3773884 may be used, for example. However, the method is not limited so and other methods may also be used.

A method of calculating the color registration error amount of each of the colors (C, M, Y) with respect to the base color black (K) is explained in the following.

First, distances between the test patterns for detecting color registration error measured by the test pattern detection unit 9 are defined using the test pattern for detecting color registration error illustrated in FIG. 4. Here, it is assumed that unit is "mm", for example.

A distance between the parallel line pattern 41K of the base color K and the parallel line pattern 41C of a target color (C, for example) is referred to as "L1c". Similarly, distances between the parallel line pattern 41K of the base color K and the parallel line patterns 41M and 41Y of target colors (M and Y) are referred to as "L1m" and "L1y" (not illustrated in the drawings), respectively. Further, here, a distance between the parallel line pattern (41Y, 41C, 41M or 41K) of a certain color and the oblique line pattern (42Y, 42C, 42M or 42K) of the same color is referred to as "L2" where color is expressed as a subscript. Thus, the distance between the parallel line pattern 41C and the oblique line pattern 42C of cyan (C) is expressed as "L2c", for example.

Further, an ideal distance (in other words, a distance between patterns generated by the test pattern generation unit 1) between the parallel line pattern 41K of the base color K and the parallel line pattern 41C of the target color (C, for example) is referred to as "L1ref". Here, an ideal distance between the parallel line patterns of K and Y is the same, "L1ref", and an ideal distance between the parallel line patterns of K and M becomes twice, "2×L1ref". Further, with reference to FIG. 3, distances measured at positions on lines "a", "b" and "c" of the test pattern detection unit 9 are expressed with "_ a", "_b" and "_c", respectively. Further, a distance between the detection units 9*a* and 9*c* of the test pattern detection unit 9 is referred to as "Lac".

With definitions as described above, each of the components of the color registration error amount can be obtained as follows.

For example, skews "d" of the colors (C, M, Y) with respect to black (K) can be obtained from the following equation 3.

$$d(C)=(L1c_c-L1c_a)/Lac$$

$$d(M)=(L1m_c-L1m_a)/Lac$$

$$d(Y)=(L1y_c-L1y_a)/Lac \tag{3}$$

Further, registration displacements "f" in the sub-scanning direction "y" of the colors (C, M, Y) with respect to black (K) can be obtained from the following equation 4.

$$f(C)=((0.25\cdot L1c_a+0.5\cdot L1c_b+0.25\cdot L1c_c)-L1\mathrm{ref})\cdot\kappa$$

$$f(M)=((0.25\cdot L1m_a+0.5\cdot L1m_b+0.25\cdot L1m_c)-2\cdot L1\mathrm{ref})\cdot\kappa$$

$$f(Y)=((0.25\cdot L1y_a+0.5\cdot L1y_b+0.25\cdot L1y_c)-L1\mathrm{ref})\cdot\kappa \tag{4}$$

Here, as described above, "κ" is a coefficient for converting a unit of the distance from "mm" to "dot".

Further, magnification errors "a" in the main-scanning direction of the colors (C, M, Y) with respect to black (K) can be obtained from the following equation 5.

$$a(C)=((L2c_c-L2k_c)-(L2c_a-L2k_a))/Lac$$

$$a(M)=((L2m_c-L2k_c)-(L2m_a-L2k_a))/Lac$$

$$a(Y)=((L2y_c-L2k_c)-(L2y_a-L2k_a))/Lac \quad (5)$$

Further, registration displacements "c" in the main-scanning direction "x" of the colors (C, M, Y) with respect to black (K) can be obtained from the following equation 6.

$$c(C)=((L2c_a-L2k_a)-Lbd\cdot a(C))\cdot\kappa$$

$$c(M)=((L2m_a-L2k_a)-Lbd\cdot a(M))\cdot\kappa$$

$$c(Y)=((L2y_a-L2k_a)-Lbd\cdot a(Y))\cdot\kappa \quad (6)$$

Here, "Lbd" means a distance between a synchronization detection sensor that is provided in each of the scanning optical systems 5 and generates a line synchronization signal 23Y, 23C, 23M or 23K when a light beam passes and the detection unit 9*a*. "Lbd·a(C)" is provided in order to subtract misregistration due to the magnification error in the main-scanning direction "x" caused by scanning from the synchronization detection sensor, that is a synchronization position in the main-scanning direction "x" to the detection unit 9*a* from the registration displacement.

When the test pattern for detecting color registration error is formed at the forming areas 33*a* and 33*c* as described above, the following equation 4' may be used instead of the equation 4. Other components can be obtained by the same equations.

$$f(C)=((0.5\cdot L1c_a+0.5\cdot L1c_c)-L1ref)\cdot\kappa \quad (4')$$

This is the same for the target colors (M) and (Y).

Further, the test pattern for detecting color registration error may have various patterns other than the patterns illustrated in the drawings. The components of the various color registration error amounts may be obtained using the various patterns.

(Method of Correcting Color Registration Error Amount by Image Data Correction Unit 3)

Next, a method of correcting the color registration error amount by the image data correction unit 3 is explained. Here, a coordinate system of an image (input image data or a test pattern for detecting color registration error) input to the image data correction unit 3 is expressed as (x, y). Further, a coordinate system of the corrected image data 22Y, 22C, 22M or 22K is expressed as (x', y'). Further, a coordinate system of an image formed on the intermediate transfer belt 7 is expressed as (x", y"). At this time, by using the color registration error amount of each of the components of the colors (Y, C, M) with respect to black (K), the color registration error generated after the writing control unit 4 can be expressed by a coordinate conversion of the following equation 7.

$$\begin{pmatrix} x'' \\ y'' \\ 1 \end{pmatrix} = A\cdot\begin{pmatrix} x' \\ y' \\ 1 \end{pmatrix} \quad A=\begin{pmatrix} a' & 0 & c \\ d & 1 & f \\ 0 & 0 & 1 \end{pmatrix} \quad (7)$$

Here, as the displacement amount "a" in equation 5 expresses the magnification error in the main-scanning direction "x", the total magnification in the main-scanning direction "x" becomes a'=1+a.

Thus, the image data correction unit 3 obtains inverse matrix $A^{-1}$ (hereinafter, referred also to as a "color registration error correction matrix") of the matrix A (hereinafter, referred also to as a "color registration error conversion matrix") in equation 7 using the color registration error amount (a', c, d, f) of each of the colors. Further, the image data correction unit 3 performs a coordinate conversion of the following equation 8 and corrects the color registration error amount of an image formed on the intermediate transfer belt 7 as indicated by the following equation 9.

$$\begin{pmatrix} x' \\ y' \\ 1 \end{pmatrix} = A^{-1}\cdot\begin{pmatrix} x \\ y \\ 1 \end{pmatrix} \quad (8)$$

$$\begin{pmatrix} x'' \\ y'' \\ 1 \end{pmatrix} = A\cdot A^{-1}\cdot\begin{pmatrix} x \\ y \\ 1 \end{pmatrix} \quad \therefore \begin{pmatrix} x'' \\ y'' \\ 1 \end{pmatrix} = \begin{pmatrix} x \\ y \\ 1 \end{pmatrix} \quad (9)$$

(Method of Correcting Color Registration Error Amount when Forming Image on Back Surface)

Next, a method of correcting the color registration error amount when forming an image on the back surface after printing an image on the front surface when printing on both surfaces is explained. For example, the adding unit 13 calculates the main-scanning magnification "a'" by the following equation 10 using a value of the magnification error "a" in the main-scanning direction "x" obtained by the above equation 5 and the main-scanning magnification "P" of a printing paper designated by a user by the data selection signal "S3" (two-dot chain line in FIG. 1).

$$a'=a+P \quad (10)$$

At this time, as it is necessary to correct the image data even for black (K), which is the base color, when forming the image on the back surface of the printing paper 10, the main-scanning magnification "a'" is obtained by using the main-scanning magnification "P" read out from the back surface information storing unit 12.

Next, the registration displacement in the main-scanning direction "c" is updated by the following equation 11 using the registration displacement in the main-scanning direction "c" obtained by the above equation 6 and a correction value "Q" of the main-scanning position of a printing paper 10 designated by a user by the data selection signal "S3".

$$c=c+Q \quad (11)$$

Similarly, the registration displacement in the main-scanning direction "c" of the base color black (K) is obtained by using the correction value "Q" of the main-scanning position read out from the back surface information storing unit 12.

Next, upon obtaining the main-scanning magnification "a'" and the registration displacement in the main-scanning direction "c" from the adding unit 13, the image data correction unit 3 inputs the values to the color registration error conversion matrix "A" of the above equation 7 and performs a coordinate conversion by the inverse matrix.

As described above, when forming the image on the back surface after printing the image on the front surface, the image is performed with the coordinate conversion based on the currently stored color registration error amount and the back surface information designated by the user, for example, to correct the color registration error amount and the back surface information. Thus, similar to a case when forming an image on the front surface of the printing paper, the color registration error can be always reduced for the back surface so that misregistrations of images formed for the front surface and the back surface of the printing paper can be reduced.

Here, depending on the printing paper P, it is necessary to calculate the main-scanning magnification "P" and the correction value "Q" of the main-scanning position for each of the lines in the sub-scanning direction. At this time, in the adding unit 13, the main-scanning magnification "P" and the correction value "Q" of the main-scanning position of the correction unit lines "V" are calculated by the following equations 12 and 13.

$$P=Ps+((Pe-Ps)/U)\cdot V \tag{12}$$

$$Q=Qs+((Qe-Qs)/U)\cdot V \tag{13}$$

The correction unit lines "V" express the lines to be corrected. Subscripts "s" and "e" of the main-scanning magnification "P" and the correction value "Q" of the main-scanning position express information about positions between which the correction unit lines "V" are inserted where a front side is expressed as "s" and a rear side is expressed as "e".

For example, with reference to the example of FIG. 7, "Ps" expresses "P1" obtained from the detected result of the test pattern 61-1 that is formed at a sub-scanning position k=1. "Pe" expresses "P2" obtained from the detected result of the test pattern 61-2 that is formed at a sub-scanning position k=2. "U" expresses the number of lines in the sub-scanning direction "y" between the test patterns 61 (between the test pattern 61-1 and the test pattern 61-2, for example) that are formed when calculating the main-scanning magnification "P" and the correction value "Q" of the main-scanning position.

Here, the adding unit 13 may calculate the main-scanning magnification "a'" and the registration displacement in the main-scanning direction "c" by equations 10 and 11 based on the values of the main-scanning magnification "P" and the correction value "Q" of the main-scanning position of each of the sub-scanning lines obtained by the above equations 12 and 13.

(Process of Calculating Color Registration Error Amount)

Figure 9:
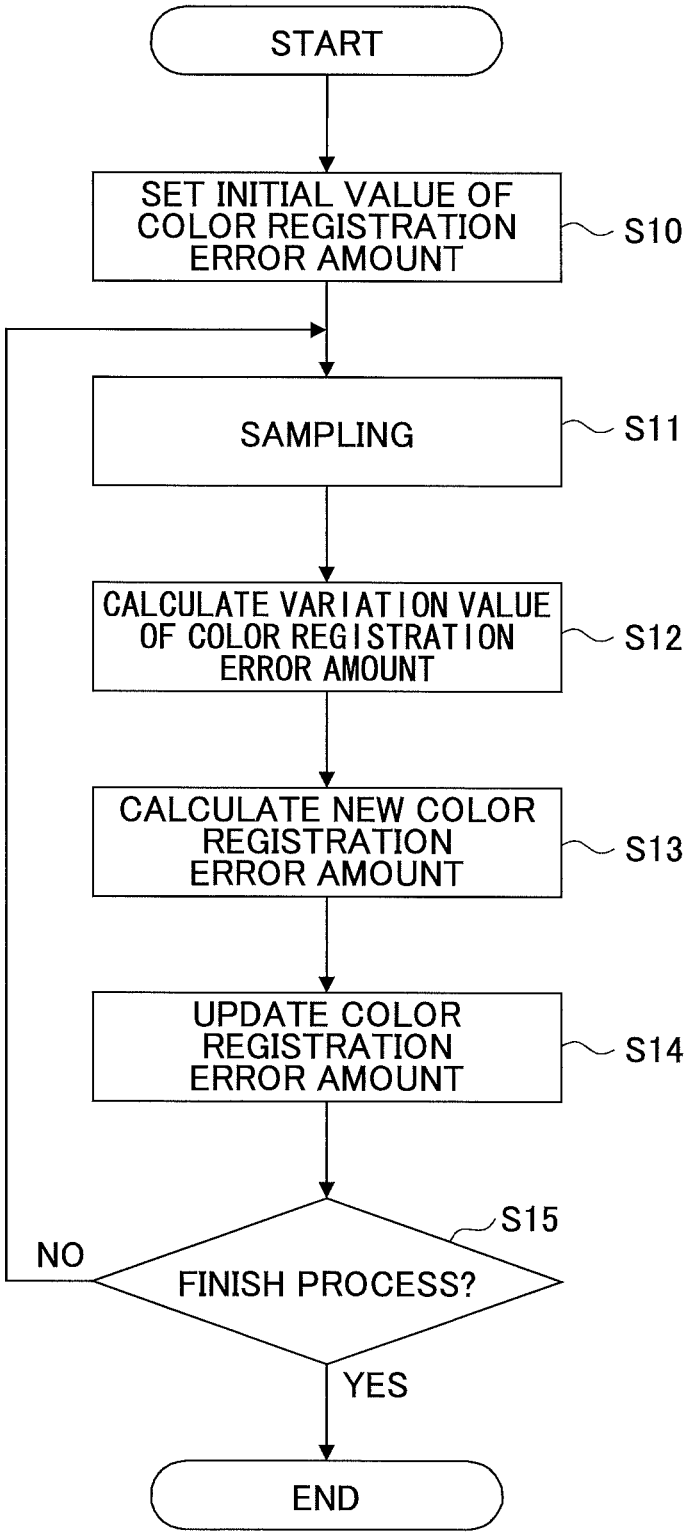
FIG. 9 is a flowchart illustrating an example of a process of calculating a color registration error amount.

Next, with reference to FIG. 9, a process of calculating the color registration error amount performed by the color registration error calculating unit 10 is explained. FIG. 9 is a flowchart illustrating a process of calculating the color registration error amount. The following process is performed for each of the colors (Y, C and M).

As illustrated in FIG. 9, the color registration error calculating unit 10 sets an initial value of the color registration error amount (S10), and stores the set initial value of the color registration error amount in the color registration error storing unit 11. Here, the initial value of the color registration error amount may be without a color registration error amount (a'=1, c=0, d=0, f=0). Alternatively, the previously used color registration error amount may be stored in the color registration error storing unit 11 as the initial value of the color registration error amount.

Further alternatively, the test pattern for detecting color registration error may be printed without correcting the color registration error and the color registration error amount obtained by a color registration error amount initial value detection process in which the color registration error amount is calculated as described above based on a detected result of the printed test pattern for detecting color registration error may be set as the initial value. At this time, a plurality sets of test patterns for detecting color registration error may be formed and an average of the detected results may be calculated to be used in order to reduce the error.

Next, the image data correction unit 3 refers to the color registration error amount stored in the color registration error storing unit 11 to obtain a color registration error correction matrix (inverse matrix $A^{-1}$), forms a corrected test pattern for detecting color registration error on the intermediate transfer belt 7 and detects (sampling) the test pattern for detecting color registration error by the test pattern detection unit 9 (S11). The detection timing is determined by the job start instruction signal "S1" and the process is paused until the timing.

Next, the color registration error calculating unit 10 calculates a variation value of the color registration error amount using the detected result obtained in S11 based on the above described equation 3 to equation 6 (S12). Here, as the detected result obtained in S11 is already corrected using the color registration error amount stored in the color registration error storing unit 11, the color registration error amount calculated in S12 becomes a variation from the stored color registration error amount. Here, variation amounts obtained from an "n"th test pattern for detecting color registration error is expressed as variation values Δa(n), Δc(n), Δd(n) and Δf(n), for example, with a subscript "n".

Next, the color registration error calculating unit 10 calculates new color registration error amounts a(n), c(n), d(n) and f(n) using the variation values Δa(n), Δc(n), Δd(n) and Δf(n) obtained in S12 (S13). In this process, the new color registration error amounts are obtained by adding the variation values of the color registration error amount obtained in S13 to the stored color registration error amounts (results calculated by an "n−1"th test pattern a(n−1), c(n−1), d(n−1) and f(n−1)). For example, a(n) is obtained as a(n)=a(n−1)+Δa(n). Other components c(n), d(n) and f(n) are similarly calculated.

The color registration error amount calculated by a set of test patterns for detecting color registration error may include an error in forming the test patterns for detecting color registration error, an error in reading by the sensor or the like. Thus, the values obtained by the above calculation may be varied due to the error (as a noise). In order to reduce the influence by the error (noise), new color registration error amounts a(n), c(n), d(n) and f(n) may be calculated using the following equation 14 by adding the values obtained by multiplying a predetermined coefficient to the variation values of the color registration error amount, for example. With this, the noise component is smoothed so that the color registration error amounts of high precise can be obtained.

$$a(n)=a(n-1)+Kp\cdot\Delta a(n) \tag{14}$$

Further, new color registration error amounts a(n), c(n), d(n) and f(n) may be calculated by a so-called proportional-integral control (PI) using the following equation 15.

$$a(n)=a(n-1)+Kp\cdot\Delta a(n)+Ki\Sigma\Sigma\Delta a(n) \tag{15}$$

Other components c(n), d(n) and f(n) may be similarly calculated.

In equation 15, "ΣΔa(n)" is an integrated value of the variation values of the color registration error amount Δa(n) from 1 to n, "Kp" is a proportional gain coefficient and "Ki" is an integral gain coefficient. A controlled bandwidth is determined by the proportional gain coefficient Kp and the integral gain coefficient Ki and a noise of the high-frequency component is limited by the controlled bandwidth.

That is, it is unnecessary to form a plurality of sets of the test patterns for detecting color registration error to obtain an average value and the color registration error amount precise enough can be obtained by a single set of short test patterns for detecting color registration error. Further, the color registration error amount can be obtained by following a variation that is less than or equal to the above described controlled bandwidth. Further, as the integrated value of the variation values of the color registration error amount Δa(n) is also reflected, it is possible to reduce a stationary error.

Further, the color registration error amount may be obtained such that the above described controlled bandwidth is capable of following a gradual variation of the temperature change or the like. Thus, when the sampling period is a few seconds, for example, the controlled bandwidth may be 1/(a few dozens) to 1/(a few hundreds) of the sampling period. Thus, the proportional gain coefficient "Kp" and the integral gain coefficient "Ki" may be determined that the controlled bandwidth satisfies that.

Further, when controlled bandwidths required for the components a, c, d and f are different (a component sensitive to the temperature change or the like), only the proportional gain coefficient "Kp" and the integral gain coefficient "Ki" for each of the components may be changed. Further, the proportional gain coefficient "Kp" and the integral gain coefficient "Ki" for each of the components may be changed so that the controlled bandwidth for each of the components becomes different and the correction of the color registration error amount for each of the components does not interfere with each other.

Next, the color registration error amounts stored in the color registration error storing unit 11 are updated by the new color registration error amounts a(n), c(n), d(n) and f(n) obtained in S13 (S14).

Next, whether to finish the process is determined (S15). It is determined that the process is finished (YES in S15), when a printing process is completed or the like, for example. On the other hand, when it is determined that the process is not finished such as the printing process is continued or the like (NO in S15), the process returns back to S11. In S11, a test pattern for detecting color registration error that is corrected using the updated color registration error amount is formed and the test pattern for detecting color registration error is detected.

By updating the color registration error amount by the above described process of calculating the color registration error amount, an up-to-date color registration error amount that follows a change over time can be calculated. Then, as a normal image is corrected by the up-to-date color registration error amount, an image for which a color registration error is always corrected can be formed.

Here, among the components of the color registration error amount, a registration displacement in the main-scanning direction and a registration displacement in the sub-scanning direction may be corrected by delaying a main-scanning synchronization signal of the writing control unit 4 or delaying a sub-scanning synchronization signal by per line unit. Thus, integer parts of the color registration error amounts of these components may be output to the writing control unit 4 (illustrated as a dotted line from the color registration error calculating unit 10 in FIG. 1) to perform delay control of the synchronization signals and only decimal parts may be stored in the color registration error storing unit 11 to be used by the image data correction unit 3 for correction.

(Another Process of Calculating Color Registration Error Amount)

Figure 10:
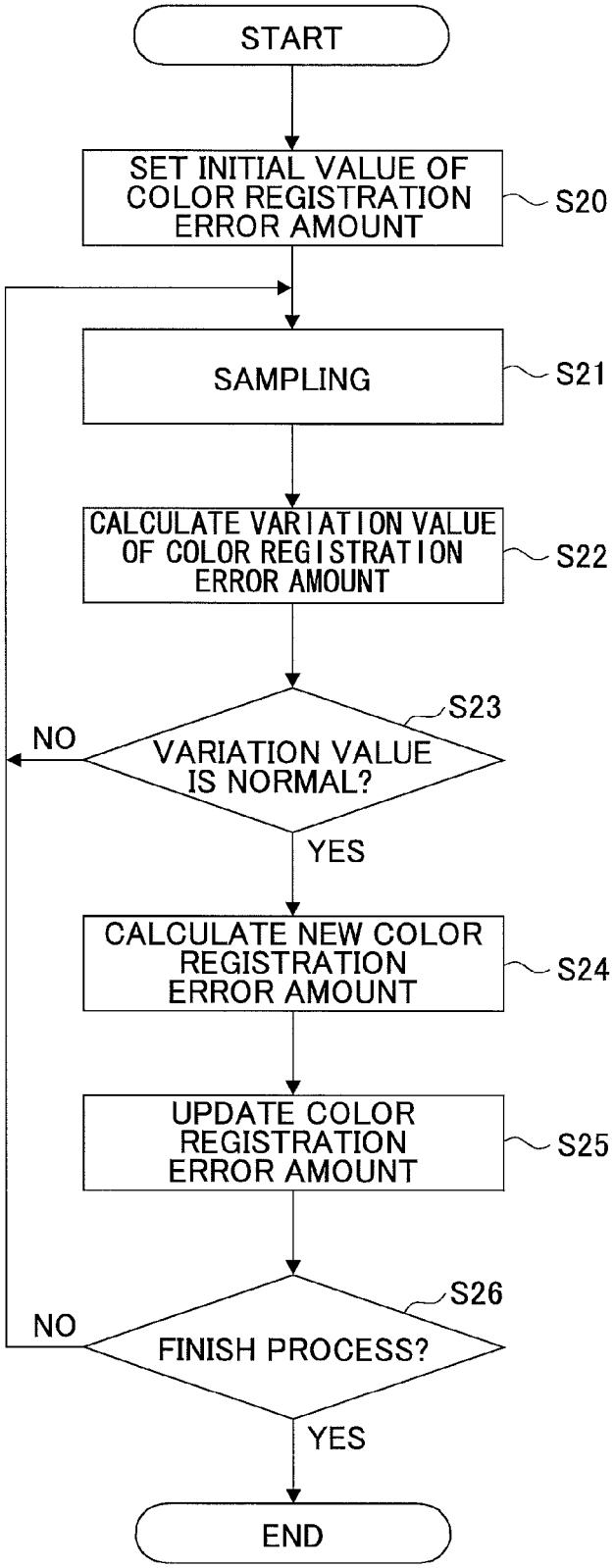
FIG. 10 is a flowchart illustrating another example of the process of calculating the color registration error amount.

Next, with reference to FIG. 10, another process of calculating the color registration error amount executed by the color registration error calculating unit 10 is explained. FIG. 10 is a flowchart illustrating another example of the process of calculating the color registration error amount. The flowchart illustrated in FIG. 10 is different from the flowchart illustrated in FIG. 9 in that a process of S23 is added. Processes of S20 to S22 in FIG. 10 are the same as the processes of S10 to S12 in FIG. 9 and processes S24 to S26 in FIG. 10 are the same as the processes of S13 to S15 in FIG. 9. Thus, explanations are not repeated.

As illustrated in FIG. 10, whether the variation values of the color registration error amounts Δa(n), Δc(n), Δd(n) and Δf(n) calculated in S22 are within a predetermined range is determined (S23). When it is determined to be within the predetermined range (YES in S23), the process proceeds to S24. On the other hand, when it is determined not to be within the predetermined range (NO in S23), the process returns back to S21 without reflecting the variation values as a detection error. At this time, the above adding calculation does not performed, for example.

For example, when there is damage or the like on the intermediate transfer belt 7, there may be a case that a detected result by the test pattern detection unit 9 when the damage passes may have an abnormal value, or the calculated variation value of the color registration error amount has a different value from an actual value due to the damage near the forming area of the test pattern for detecting color registration error.

Thus, by providing the process of S23, the abnormal value is not reflected on the calculation of the color registration error amount in S24 and the color registration error amount can be stably obtained without being influenced by the abnormal value. When the variation value of the color registration error amount is periodically detected within a short period, normally, the variation value of the color registration error amount is not large. Thus, by setting a threshold value for determining abnormal to be relatively small (a few ten microns or the like, for example) in S23, the abnormal value due to the damage or the like can be easily determined.

Further, when an abnormal value is detected for one of the components, there may be a possibility that the other components are also influenced by the damage or the like and the variation values of the color registration error amounts are not normally detected. Thus, when the abnormal value is detected for one of the components, the color registration error amounts of other components may not be calculated and updated as well.

(Job Start Instruction)

Figure 11:
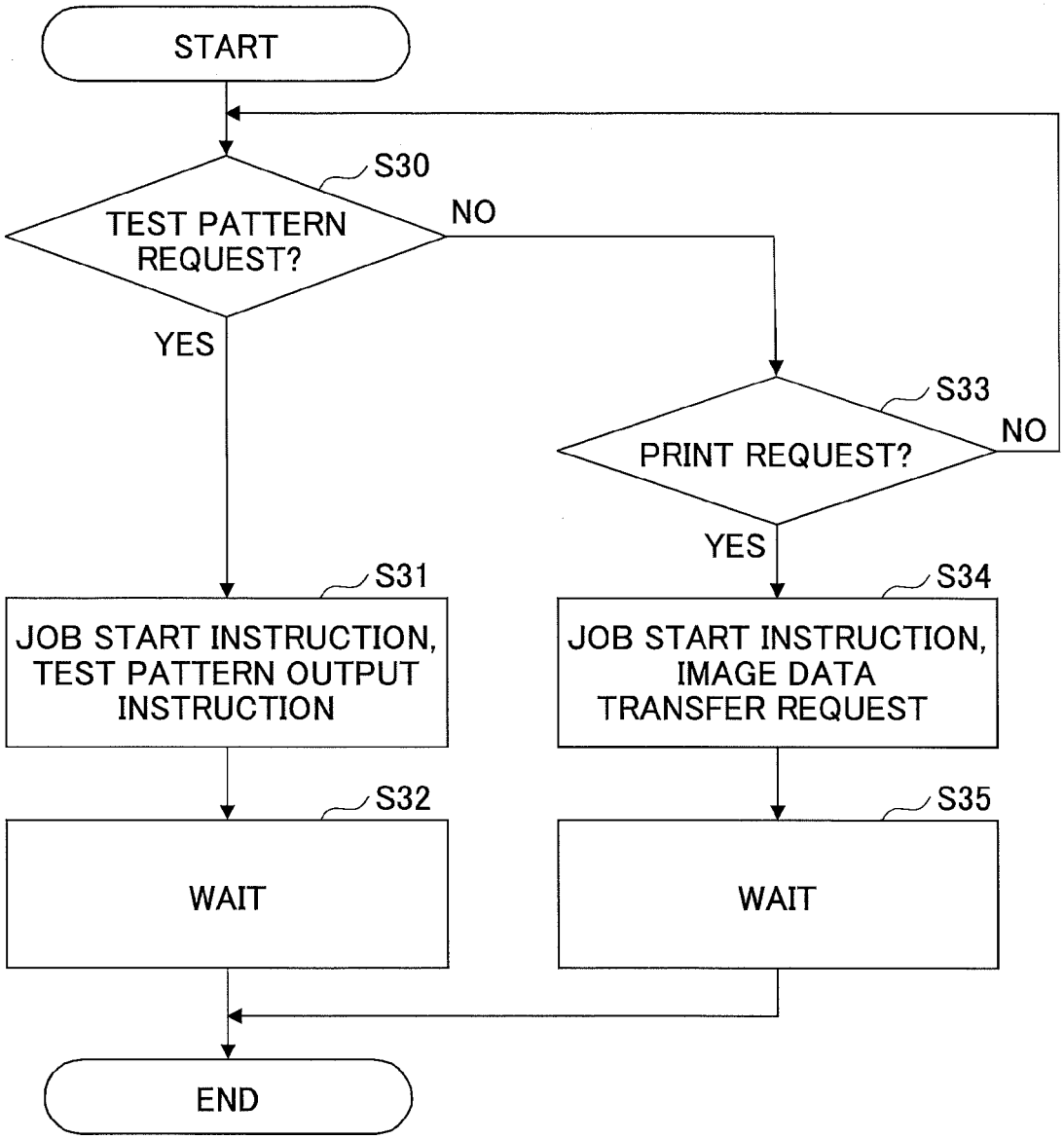
FIG. 11 is a flowchart illustrating an example of a process of a start instruction of a print job.

Next, with reference to FIG. 11, a job start instruction by the job control unit 14 is explained. FIG. 11 is a flowchart illustrating an example of a process of the job start instruction.

As illustrated in FIG. 11, the job control unit 14 determines whether there is a request of generating the test pattern for detecting color registration error (S30). When it is determined that there is the request of generating the test pattern for detecting color registration error (YES in S30), the job control unit 14 issues a job start instruction signal "S1" and an output instruction signal of the test pattern for detecting color registration error (S31).

The request of generating the test pattern for detecting color registration error is made by a routine included in the job control unit 14 that issues the request of generating the test pattern for detecting color registration error after a predetermined period ("Ts" in FIG. 2) from the previous test pattern for detecting color registration error output instruction.

Next, the process is paused for a period corresponding to an output period of the test pattern for detecting color registration error ("Ttp" in FIG. 2) so that another print job is not issued (S32). Then, the process is finished.

Meanwhile, when it is determined that there is not a request of generating the test pattern for detecting color registration error (NO in S30), the job control unit 14 determines whether there is a request of printing (S33). When it is determined that there is the request of printing (YES in S33), the job control unit 14 issues a job start instruction signal "S1" and a request signal of transferring image data "R2" (S34). When it is determined that there is not a request of printing (NO in S33), the process returns to S30.

Next, the process is paused for a period corresponding to an output period of the image data ("Tprint" in FIG. 2, which varies depending on the size of a paper for printing) so that another print job is not issued (S35). Then, the process is finished.

By instructing to start print jobs of the test pattern for detecting color registration error and the normal image in accordance with the processes as described above, the test pattern for detecting color registration error and the normal image can be periodically formed while preventing the test pattern for detecting color registration error from overlapping the image area of the normal image.

(Hardware Structure)

Figure 12:
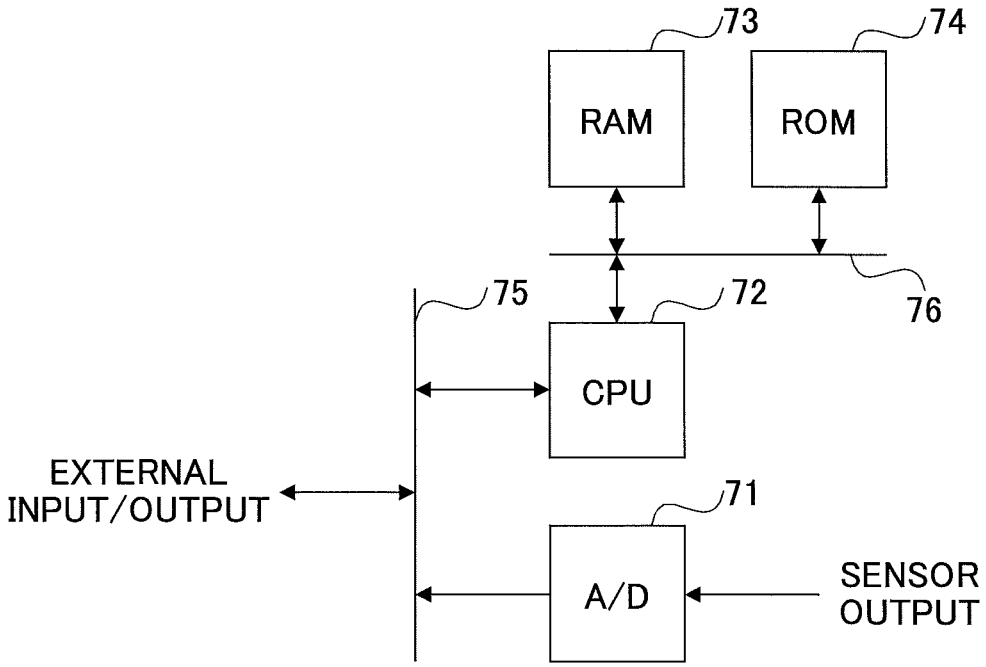
FIG. 12 is a view illustrating an example of a hardware structure that executes a program to function as each unit.

Next, with reference to FIG. 12, an example of a hardware structure that performs a program or the like that functions as the color registration error calculating unit 10, the color registration error storing unit 11, the back surface information storing unit 12, the adding unit 13, the job control unit 14 or the like of the image forming apparatus 100. FIG. 12 is a view illustrating an example of a hardware structure that executes a program to function as each unit. The structure illustrated in FIG. 12 may have a function of an engine controller that controls an operation timing of each of the units of the image forming apparatus 100.

The image forming apparatus 100 includes an A/D converter 71, a CPU 72, a RAM 73, a ROM 74, an I/O (input/output) port 75, a memory bus 76 and the like.

The A/D converter 71 converts a signal (sensor output) obtained from the test pattern detection unit 9 to digital data. The A/D converter 71 is connected to the I/O port 75. The A/D converter 71 may be connected to the I/O port 75 via a signal processing unit that performs a signal processing such as a filter processing or the like, a buffer memory or the like.

The I/O port 75 is connected to the A/D converter 71, the CPU 72, external blocks and the like, and transmits input/output signals between the CPU 72 and other units. The request signal of printing an image "R1", issuing of the job start instruction signal "S1", updating of the color registration error amount to the image data correction unit 3 or the like is performed via the I/O port 75.

The back surface information obtained from the external image reading device is input via the I/O port 75 and stored in the back surface information storing unit 12 via the I/O port 75.

The CPU 72 inputs and outputs data between the external units via the I/O port 75 and performs processes such as the calculation of the color registration error amount, control of starting a print job or the like. The CPU 72 is connected to the RAM 73 and the ROM 74 via the memory bus 76. The ROM 74 stores a program for calculating the color registration error amount and other various programs.

Second Embodiment (Overall Structure of Image Forming Apparatus: Block Diagram)

Figure 13:
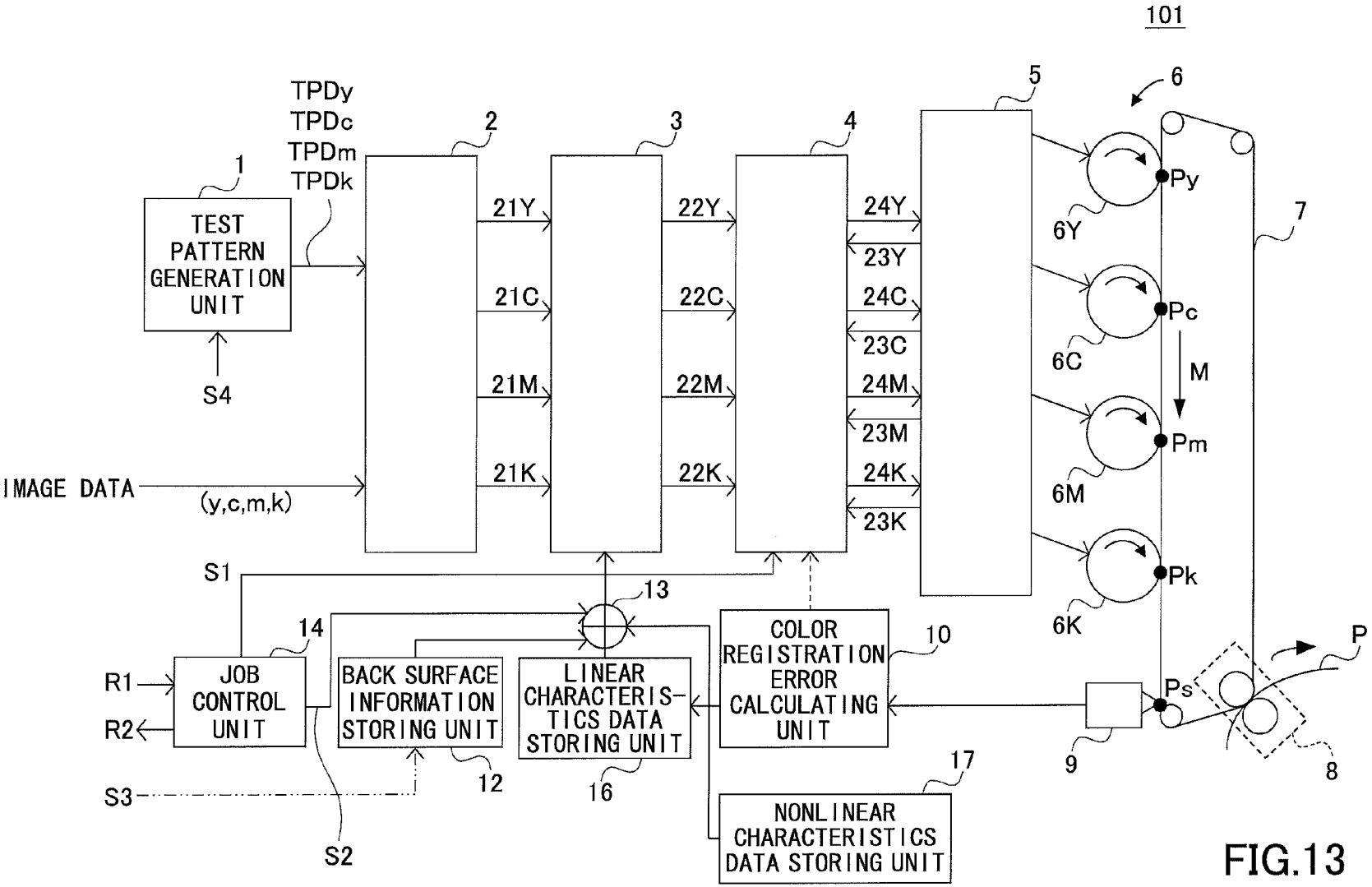
FIG. 13 is a block diagram for explaining an example of an overall structure of the image forming apparatus of a second embodiment.

Next, a second embodiment is explained. FIG. 13 is a block diagram illustrating an example of an image forming apparatus 101 of the second embodiment.

For the image forming apparatus 101 illustrated in FIG. 13, the same components as those of the image forming apparatus 100 illustrated in FIG. 1 are given the same reference numerals, explanations are not repeated and points that differ are mainly explained.

As illustrated in FIG. 13, the image forming apparatus 101 includes the test pattern generation unit 1, the image path switching unit 2, the image data correction unit 3, the writing control unit 4, the scanning optical system 5, the photosensitive drums 6 (the photosensitive drums 6Y, 6C, 6M and 6K, for example), the intermediate transfer belt 7, the secondarily transfer unit 8, the test pattern detection unit 9, the color registration error calculating unit 10, the back surface information storing unit 12, the adding unit 13, the job control unit 14, a linear characteristics data storing unit 16 and a nonlinear characteristics data storing unit 17.

In the second embodiment, different from the first embodiment, the color registration error amount is categorized into characteristics data corresponding to each factor (component). In other words, the color registration error amount is categorized into linear characteristics data that corresponds to a factor indicating linear characteristics and nonlinear characteristics data that corresponds to a factor indicating nonlinear characteristics and separately stored.

The linear characteristics data storing unit 16 stores a previously obtained linear characteristics component of the color registration error amount for each of the colors.

The color registration error calculating unit 10 calculates a variation amount from the ideal value based on the detected result of the test pattern for detecting color registration error as the variation amount of the color registration error amount. Then, the color registration error calculating unit 10 calculates a linear characteristics component (linear characteristics data) of the color registration error amount based on the calculated variation amount of the color registration error amount and the linear characteristics component of the color registration error amount stored in the linear characteristics data storing unit 16. Then, the linear characteristics data storing unit 16 is updated to store the newly calculated linear characteristics component of the color registration error amount.

The nonlinear characteristics data storing unit 17 stores a previously obtained nonlinear characteristics component of the color registration error amount for each of the colors. The linear characteristics data and the nonlinear characteristics data of the color registration error amount are explained later in detail.

The adding unit 18 adds the current linear characteristics component of the color registration error amount obtained from the linear characteristics data storing unit 16 and the current nonlinear characteristics component of the color registration error amount obtained from the nonlinear characteristics data storing unit 17 to output as the current color registration error amount.

Here, when printing an image on the back surface after printing an image on the front surface in printing on both surfaces, the adding unit 18 obtains the back surface information of the printing paper corresponding to the data selection signal "S3" from the back surface information storing unit 12, and adds the back surface information to the current color registration error amount.

(Nonlinear Component)

Figure 14A:
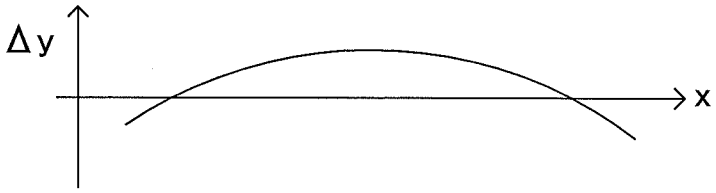
FIG. 14A and FIG. 14B are views for explaining other factors of the color registration error.
Figure 14B:
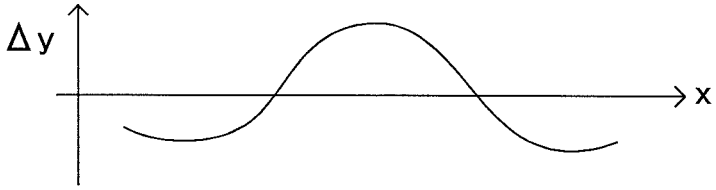

FIG. 14A and FIG. 14B are views for explaining factors of the color registration error regarding a nonlinear component. FIG. 14A is a view illustrating an example of a bow of a scanning line due to an accuracy error or the like of the optical system. FIG. 14B is a view illustrating an example of curved characteristics having higher-degree components more than or equal to cubic in the main-scanning direction.

As illustrated in FIG. 14A and FIG. 14B, as a factor of the color registration error, a nonlinear component that has nonlinear characteristics for the distance in the main-scanning direction "x" or in the sub-scanning direction "y" is included in addition to the linear component that has linear characteristics for the distance. FIG. 14A and FIG. 14B illustrate an example of curves in the main-scanning direction "x".

Further, as the factor of the color registration error having nonlinear characteristics, magnification deviation is included. The magnification deviation occurs, mainly due to an accuracy error of f-θ lens, as the scanning speed on the photosensitive drum in the main-scanning direction "x" is not constant and deviation occurs in the main-scanning position so that the main-scanning magnification of a formed image is partially different.

In this embodiment, in addition to correcting the nonlinear component of the color registration error, misregistration and distortion of the image that is formed on the back surface after printing the image on the front surface are corrected.

(Color Registration Error Amount Characteristics Data)

Figure 15:
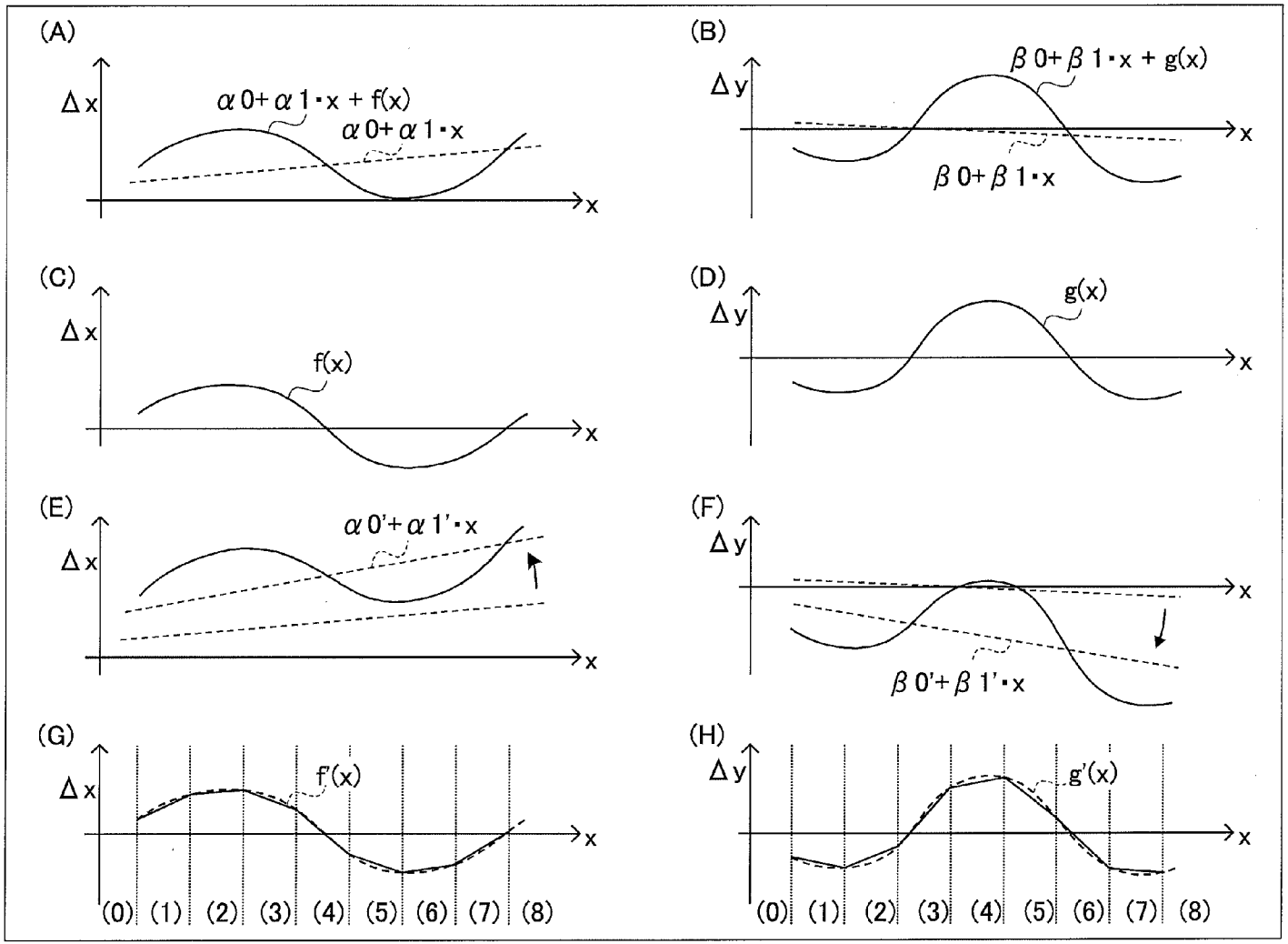
FIG. 15 is a view for explaining color registration error amount characteristics data of a nonlinear component.

FIG. 15 is a view for explaining color registration error amount characteristics data of a nonlinear component. In FIG. 15, (A) illustrates an example of misregistration characteristics (color registration error) "Δx" at the main-scanning position "x" in the main-scanning direction, and (B) illustrates an example of misregistration characteristics "Δy" at the main-scanning position "x" in the sub-scanning direction. Here, the misregistration characteristics "Δx" occurs due to a partial magnification deviation in the main-scanning direction, and the misregistration characteristics "Δy" occurs due to a bow of a scanning line, for example.

In (A) and (B) of FIG. 15, the misregistration characteristics Δx(x) and the misregistration characteristics Δy(x) can be expressed as follows by approximating with polynomials, respectively.

$$\Delta x(x)=\alpha 0+\alpha 1\cdot x+\alpha 2\cdot x2+\alpha 3\cdot x3+\ldots \quad (16)$$

$$\Delta y(x)=\beta 0+\beta 1\cdot x+\beta 2\cdot x2+\beta 3\cdot x3+\ldots \quad (17)$$

In equation 16 and equation 17, the 0 degree term and the linear term express linear characteristics and the 2nd degree term and more than the 2nd degree term express nonlinear characteristics. By substituting the sum of these higher-degree components more than or equal to quadric, expressing the nonlinear characteristics, by functions f(x) and g(x), respectively, equation 16 and equation 17 can be expressed as follows.

$$\Delta x(x)=\alpha 0+\alpha 1\cdot x+f(x) \quad (16')$$

$$\Delta y(x)=\beta 0+\beta 1\cdot x+g(x) \quad (17')$$

In equation 16 and equation 16', the coefficient "α0" of the function of degree 0 expresses a registration displacement in the main-scanning direction (margin displacement) and the linear function "α1" expresses total magnification displacement of the main-scanning position. Similarly, in equation 17 and equation 17', the coefficient "β0" of the function of degree 0 expresses a registration displacement in the sub-scanning direction (margin displacement) and the linear function "β1" expresses skew.

Further, in FIG. 15, (C) illustrates a function f(x) that is nonlinear characteristics of registration displacement in the main-scanning direction and (D) illustrates a function g(x) that is nonlinear characteristics of misregistration in the sub-scanning direction.

As described above, the color registration error amount may be changed over time due to the deformation of the optical system, a holding member or the like by a change of temperature in the apparatus or the like. The coefficient in the equations including equation 16, equation 16', equation 17 and equation 17' that largely varies due to the temperature change, or the like, depends on the structure of the optical system or the like (including materials or the like of each component or holding member).

In this embodiment, it is assumed that the linear characteristics factors (α0, α1, β0 and β1 in the above equations) vary largely with respect to the temperature change while the nonlinear characteristics factors (f(x) and g(x) in the above equations) does not vary at all with respect to the temperature change (small enough with respect to a permissible value of the color registration error).

In FIG. 15, (E) illustrates an example in which the linear component of the color registration error amount in the main-scanning direction is changed by a temperature change, and (F) illustrates an example in which the linear component of the color registration error amount in the sub-scanning direction is changed by the temperature change. In these examples, the coefficients α0, α1, β1 and β1 of the above described equations are largely changed to α0', α1', β0' and β1', respectively. It is assumed that the nonlinear characteristics f(x) and g(x) are not changed.

Further, in FIG. 15, (G) illustrates f'(x) obtained by a polygonal line approximation of the nonlinear characteristics f(x) and (H) illustrates g'(x) obtained by a polygonal line approximation of the nonlinear characteristics g(x). In (G) and (H) of FIG. 15, the nonlinear characteristics f(x) and g(x) are divided into eight areas, for example, with the same interval in the main-scanning direction and the nonlinear characteristics f(x) and g(x) are expressed as a line by polygonal line approximation in each area, respectively. With this, calculation for the correction of the image data can be simplified.

As illustrated in (G) and (H) in FIG. 15, by dividing the nonlinear characteristics f(x) and g(x) by the same areas, the number of areas of a color registration error conversion matrix, which will be explained later, can be reduced and the calculation for the correction of the image data can be simplified. The accuracy of the polygonal line approximation can be increased by increasing the number of areas.

It is unnecessary to have the areas to have the same interval. The areas may be determined such that maximum points and minimum points of the curves of the nonlinear characteristics position at interfaces of the areas to decrease the difference between the curves of the nonlinear characteristics and the polygonal approximation lines.

In (G) of FIG. 15, displacement in the main-scanning direction, the inclination of the nonlinear characteristics (polygonal line approximation) of each area, is a deviation of partial magnification of the main-scanning position from total magnification. Thus, assuming the inclination as "Δa(i)" ("i" is area number), the partial magnification of the main-scanning position of each area can be obtained by adding the inclination "Δa(i)" of each area to the total magnification displacement of the main-scanning position "α1".

The registration displacement in the main-scanning direction of each area can be obtained by adding offset "Δc(i)" ("i" is area number) at a starting point of each area to the registration displacement in the main-scanning direction (margin displacement) "α0".

Similarly, in (H) of FIG. 15, displacement in the sub-scanning direction, the inclination of the nonlinear characteristics (polygonal line approximation) of each area, is a deviation from a total skew in each area. Thus, assuming the inclination as "Δd(i)" ("i" is area number), the skew of each area can be obtained by adding the inclination "Δd(i)" of each area to the total skew "β1".

The registration displacement in the sub-scanning direction of each area can be obtained by adding offset "Δf(i)" ("i" is area number) at a starting point of each area to the registration displacement in the sub-scanning direction (margin displacement) "β0".

Factors (components) of the linear characteristics factors of the color registration error amount such as skew, the registration displacement (margin displacement, offset displacement) in the sub-scanning direction, the total magnification displacement in the main-scanning direction, the registration displacement in the main-scanning direction, can be calculated as described above in the first embodiment using the detected result of the test pattern for detecting color registration error illustrated in FIG. 4, for example.

Next, a method of calculating the nonlinear characteristics factors such as f(x), g(x), or the polygonal approximation lines is explained. The nonlinear characteristics are obtained at an arbitrary timing such as when manufacturing the image forming apparatus 101, when exchanging a unit, a timing of maintenance by a service man or a user, or the like. For example, by printing a test pattern as illustrated in FIG. 16 and reading it by an image reading device such as a scanner or the like, the nonlinear characteristics can be obtained from read image data.

The image reading device may be an external device or included in the image forming apparatus 101. Further, the image reading device may be one that reads a test pattern formed on the intermediate transfer belt 7, and in such a case, it is unnecessary to secondarily transfer on a paper or the like, for example.

(Test Pattern for Obtaining Nonlinear Characteristics)

Figure 16:
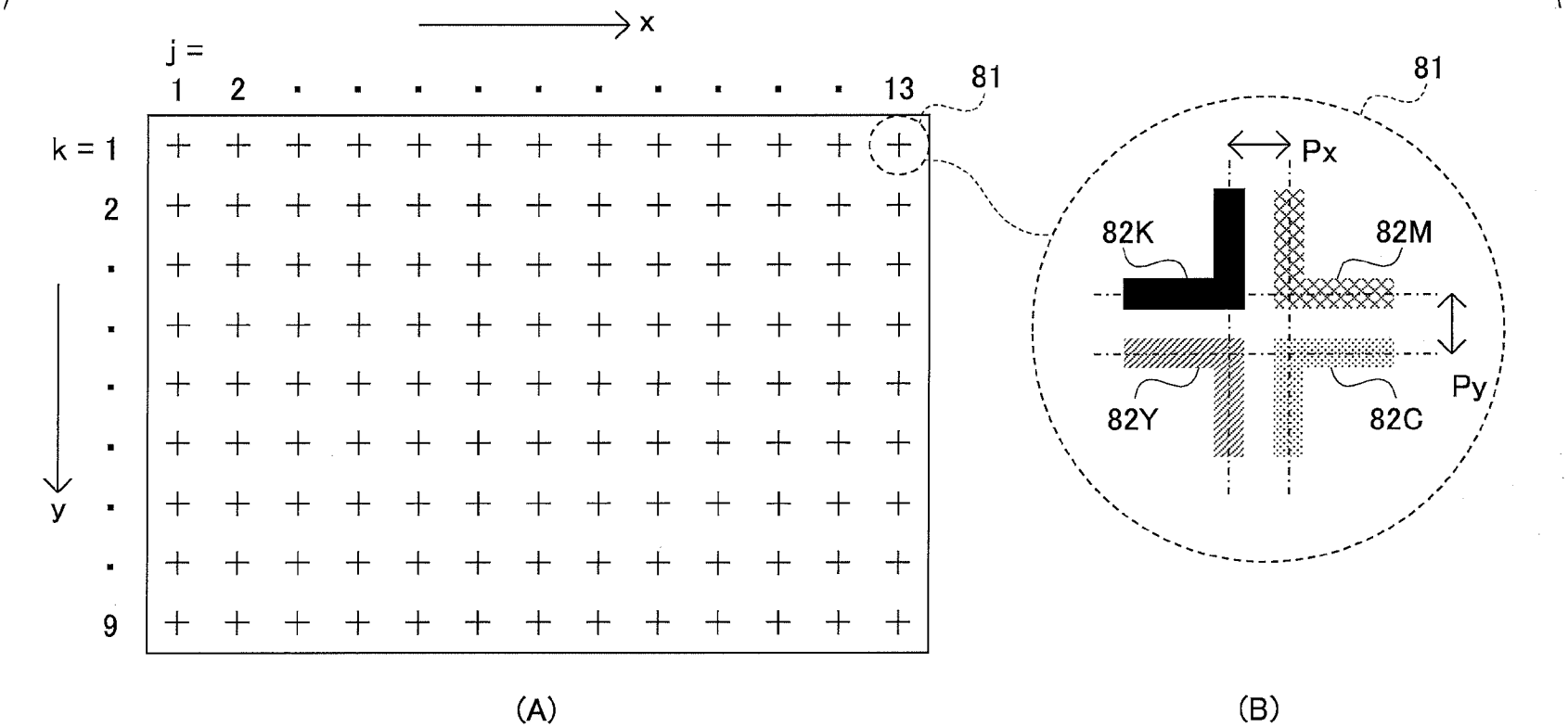
FIG. 16 is a view illustrating a test pattern that is printed to obtain nonlinear characteristics.

FIG. 16 is a view illustrating a test pattern for obtaining nonlinear characteristics. In FIG. 16, (A) illustrates an example of positions of test patterns for detecting the nonlinear characteristics formed on the intermediate transfer belt 7 or on the printing paper, and (B) illustrates an enlarged view of the test pattern illustrated in (A).

In (A) of FIG. 16, 13 test patterns 81 (fourth test patterns) are aligned in the main-scanning direction "x" and 9 test patterns 81 are aligned in the sub-scanning direction "y", at the same interval. The number of the test patterns 81 are not limited so and the test patterns 81 may not be aligned at the same interval.

Each of the test patterns 81 has a cruciform, for example. Specifically, as illustrated in (B) of FIG. 16, each of the test patterns 81 includes four patterns 82C, 82M, 82Y and 82K, each having an "L" shape, with colors of cyan, magenta, yellow and black. An ideal distance between the patterns 82K and 82M or the patterns 82Y and 82C in the main-scanning direction "x" is "Px" and an ideal distance between the patterns 82K and 82Y or the patterns 82M and 82C in the sub-scanning direction "y" is "Py".

In this embodiment, the test patterns 81 are printed and image data of the test patterns 81 is obtained by reading the test patterns 81. Then, apexes (cross points of patterns extending in the main-scanning direction "x" and in the sub-scanning direction "y") of each of the patterns 82C, 82M, 82Y and 82K are obtained from the image data. At this time, each of the test patterns 81 is specified by a main-scanning position "j" and a sub-scanning position "k". For each of the test patterns 81, a registration amount from the ideal value "Px" or "Py" is calculated to obtain the color registration error amount near the area. Here, it is assumed that the color registration error amounts in the main-scanning direction "x" and in the sub-scanning direction "y" at the main-scanning position "j" and the sub-scanning position "k" are expressed as Δxjk (main-scanning direction displacement) and Δyjk (sub-scanning direction displacement), respectively.

Thus, for the example illustrated in (A) of FIG. 16, the color registration error amounts are obtained for each of the 117 (13×9) test patterns 81.

For example, for the nonlinear characteristics in the main-scanning direction "x", average values "Δxj" and "Δyj" of the displacements in the main-scanning direction and the displacements in the sub-scanning direction, respectively, at each of the main-scanning positions "j" are obtained by averaging the displacements "Δx" in the main-scanning direction and the displacements "Δy" in the sub-scanning direction at the sub-scanning positions "k" (k=1 to 9) at the respective main-scanning position "j". With this, a noise component, a detection error or the like can be canceled, for example.

With this, the color registration error amount (Δxj, Δyj) at the main-scanning position "j" is obtained. (A) and (B) of FIG. 15 can be obtained by plotting this result. In (A) and (B) of FIG. 15, the main-scanning position "j" is expressed as an actual distance "x".

As described above, the nonlinear characteristics are obtained by subtracting a function of degree 0 component and a linear component from the color registration error amount (Δxj, Δyj) at the main-scanning position "j". Thus, f(x) and g(x) are obtained by subtracting the function of degree 0 component and the linear component from an approximation straight line of the obtained color registration error amount (Δxj, Δyj).

Further, as described above, polygonal approximation lines of the nonlinear characteristics f(x) and g(x) may be obtained. For example, the number of areas divided in the main-scanning direction "x" may be 14 (adding "1" to the number of the test patterns aligned in the main-scanning direction "13"). Then, the color registration error amounts ("Δxj" and "Δyj") (j=1 to 13) are plotted, approximation straight lines "Δxj'" and "Δyj'" of each are obtained, and then polygonal approximation lines f'(x) and g'(x) can be obtained by connecting the approximation straight lines "Δxj'" and "Δyj'".

For example, a deviation Δa(1) of the partial magnification of the main-scanning position of an area (1) from the total magnification is (Δx2'−Δx1')/Lx ("Lx" is a distance between test patterns positioned at j=1 and 2). As such, a starting point "x" of the area, offsets "Δc(i)" and "Δf(i)" at the starting point, inclinations Δa(i) and Δd(i) at the area are calculated for each area (i). The calculated result is stored in the nonlinear characteristics data storing unit 17 as nonlinear component data of the color registration error amount.

The number of areas divided in the main-scanning direction may be simplified by subtracting, without matching with the number of the patterns in the main-scanning direction, or accuracy of the polygonal approximation lines may be increased by increasing the number of patterns.

The image may not be corrected in the image data correction unit 3 when printing the test patterns 81, and the nonlinear characteristics obtained as described above may be stored as it is in the nonlinear characteristics data storing unit 17 as the characteristics data. Further, alternatively, the image may be corrected in the image data correction unit 3 in accordance with the currently stored color registration error amount and the test pattern 81 may be printed. At this time, the obtained nonlinear characteristics indicate variation amount from the currently stored characteristics data. Thus, the obtained nonlinear characteristics are added to the currently stored color registration error amount to update the color registration error amount stored in the nonlinear characteristics data storing unit 17.

When the nonlinear characteristics in the main-scanning direction are expressed by the polygonal approximation lines of areas divided in the main-scanning direction as described above, the color registration error conversion matrix A in the above equation 7 may be obtained for each area, and the inverse matrix may be obtained for each area to perform the coordinate conversion. At this time, the color registration error factor indicating nonlinear characteristics such as the bow of a scanning line, partial magnification of the main-scanning position deviation or the like can also be precisely corrected.

In other words, assuming that the color registration error conversion matrix of each area is "Ai" and components of the matrix are defined as the following equation 18, each of the components can be expressed as four equations of equation 19. Then, the color registration error conversion matrix "Ai" of the corresponding area is selected in accordance with the main-scanning coordinate "x" of an image to be converted, and the coordinate conversion is performed by the selected inverse matrix.

$$Ai = \begin{pmatrix} ai' & 0 & ci \\ di & 1 & fi \\ 0 & 0 & 1 \end{pmatrix} \tag{18}$$

$$ai' = a' + \Delta a(i)$$

$$ci = c + \Delta c(i)$$

$$di = d + \Delta d(i)$$

$$fi = f + \Delta f(i) \tag{19}$$

Here, values "a'", "c", "d" and "f" can be obtained from the above described equation 3 to equation 6. "Δa(i)", "Δc(i)", "Δd(i)" and "Δf(i)" are offsets and inclinations of the nonlinear characteristics (polygonal approximation lines) of the displacement in the main-scanning direction and the displacement in the sub-scanning direction of each area.

As described above, these characteristics, in other words, the color registration error conversion matrix of each area varies in accordance with the temperature change. Thus, similar to the flowchart illustrated in FIG. 9, by calculating the color registration error amount of each area in the color registration error calculating unit 10, and updating the color registration error amount, the color registration error amount at that time that follows change over time can be obtained and can be stored.

Further, an image, the color registration error of which is always corrected, can be formed because the nonlinear characteristics that do not vary largely in accordance with the temperature change is previously obtained and a normal image is corrected by the color registration error amount to which the nonlinear characteristics are added.

The method of calculating the color registration error amount may be appropriately changed from the flowchart illustrated in FIG. 10. For example, when the variation value of the color registration error amount calculated in S22 of any one of the areas is out of a predetermined range in S23, the process returns to S21 without reflecting the variation value of the color registration error amount, as it is determined as a detection error, to calculate the color registration error. With this, an abnormal value due to damage or the like, for example, can be easily determined and the color registration error amount can be accurately calculated.

(Method of Calculating Color Registration Error Amount when Forming Image on Back Surface)

Next, when forming an image on the back surface after printing an image on the front surface in printing on both surfaces, the main-scanning magnification "P" of the printing paper designated by a data selection signal "S3" (two-dot chain line illustrated in FIG. 14) by a user is read from the back surface information storing unit 12, and the main-scanning magnification "ai'" is calculated based on the following equation 20.

$$ai' = a + La(i) + P \tag{20}$$

At this time, when forming an image on the back surface of the printing paper, as it is necessary to correct image data even for the base color black (K), the main-scanning magnification "P" read from the back surface information storing unit 12 is used as the main-scanning magnification "ai'".

Next, the registration displacement in the main-scanning direction "ci" is obtained based on the following equation 21 by reading the correction value "Q" of the main-scanning position of the printing paper designated a data selection signal "S3" by a user from the back surface information storing unit 12.

$$Ci = c + \Delta c(i) + Q \tag{21}$$

Similarly, the registration displacement in the main-scanning direction "ci" of the base color black (K) is obtained using the correction value "Q" of the main-scanning position the read out from the back surface information storing unit 12.

Next, a coordinate conversion using the inverse matrix is performed by inputting the main-scanning magnification "ai'" and the registration displacement in the main-scanning direction "ci" in the matrix "Ai" of the above equation 18.

Depending on the printing paper, there may be a case that the main-scanning magnification "P" and the correction value "Q" of the main-scanning position need to be calculated for each line in the sub-scanning direction. Thus, similar to the embodiment as described above, the main-scanning magnification "P" and the correction value "Q" of the main-scanning position of the correction unit lines "V" may be calculated by the adding unit 18 by equation 12 and equation 13.

As described above, according to the embodiments, a color registration error of a back surface due to a contraction after printing an image on a front surface can be controlled in real time.

Third Embodiment (Schematic Structure of Image Forming Apparatus)

Figure 17:
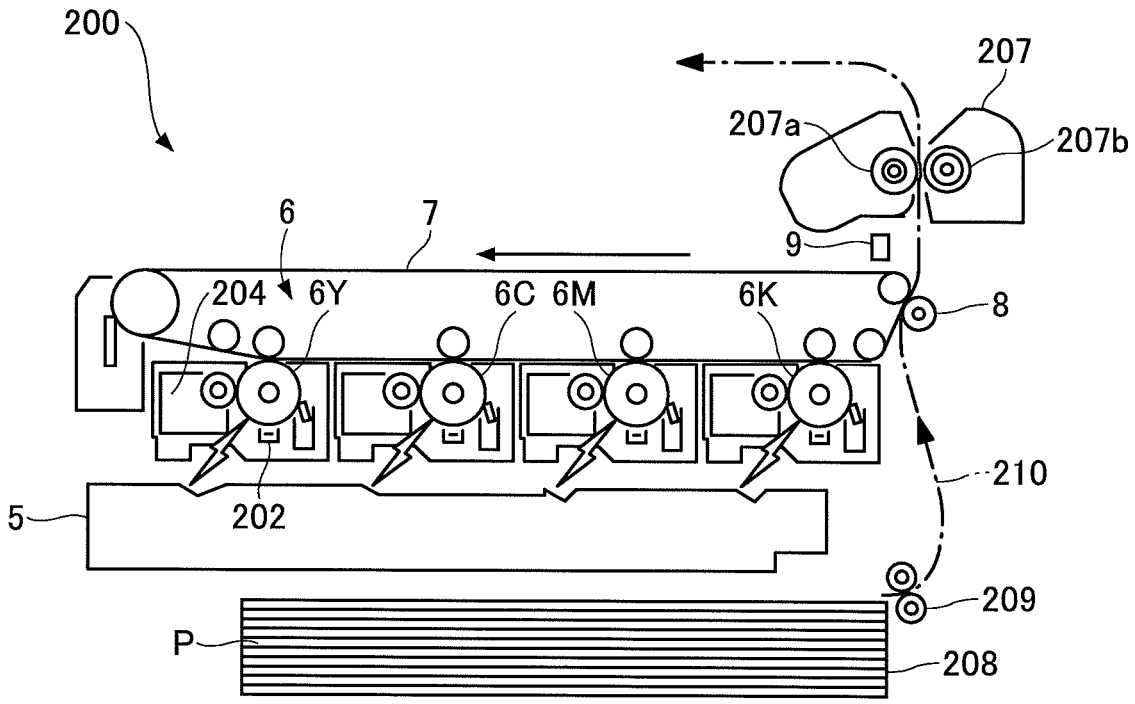
FIG. 17 is a view illustrating an example of a schematic structure of the image forming apparatus of a third embodiment.

FIG. 17 is a view illustrating an example of a schematic structure of an image forming apparatus 200 of a third embodiment. The image forming apparatus 200 may be an electrophotographic image forming apparatus that is a so-called tandem image forming apparatus including a plurality of image forming units and a secondarily transfer mechanism.

The image forming apparatus 200 includes the plurality of photosensitive drums 6 corresponding to colors such as yellow (Y), cyan (C), magenta (M), black (K) and the like (hereinafter, marks in brackets indicate the colors).

The image forming apparatus 200 includes the photosensitive drums 6 (photosensitive drums 6Y, 6C, 6M and 6K, for example) corresponding to the plurality of colors, charging devices 202, the scanning optical systems (an exposure equipment) 5, developing devices 204, the intermediate transfer belt 7, the secondarily transfer unit 8, a fixing device 207, a paper-feed cassette 208 and a registration roller 209.

When the image forming apparatus 200 forms an image, the photosensitive drums 6 are operated to rotate at a predetermined process speed and front surfaces of the photosensitive drums 6 are uniformly charged by the charging devices 202. Then, by the exposure of the scanning optical system 5, electrostatic latent images are formed in accordance with image data of a document read by a reading device, for example. Then, the developing devices 204 develop the electrostatic latent images by toners (developers) so that toner images are formed on the photosensitive drums 6Y, 6C, 6M and 6K, respectively.

The intermediate transfer belt 7 is operated to rotate at a predetermined process speed and the toner images formed on the photosensitive drum 6Y, 6C, 6M and 6K are transferred in order to be overlapped with each other (primarily transfer). The printing medium P in the paper-feed cassette 208 is conveyed to the secondarily transfer unit 8 via the registration roller 209 by the medium conveying path 210 at a predetermined timing. The toner image held on the transfer belt 5 is transferred to the printing medium P in an overlapped manner by the secondarily transfer unit 8 (secondarily transfer). The printing medium P may be, a paper, a plastic sheet, a metal sheet or the like.

The printing medium P on which the toner image is transferred is conveyed to the fixing device 207. The toner image is fixed to the printing medium P at the fixing device 207 while being heated and pressed between a fixing roller 207*a* and a pressing roller 207*b*. The printing medium P to which the toner image is fixed is ejected by an ejection roller (not illustrated in the drawings) to outside.

The test pattern detection unit 9 for detecting a test pattern is provided at a downstream position of the intermediate transfer belt 7. The test pattern detection unit 9 detects a position of a mark (image for position detection) of the test pattern of each color based on the moving speed of the test pattern and a passing timing. The test pattern detection unit 9 is explained later in detail.

(Overall Structure of Image Forming Apparatus: Block Diagram)

Figure 18:
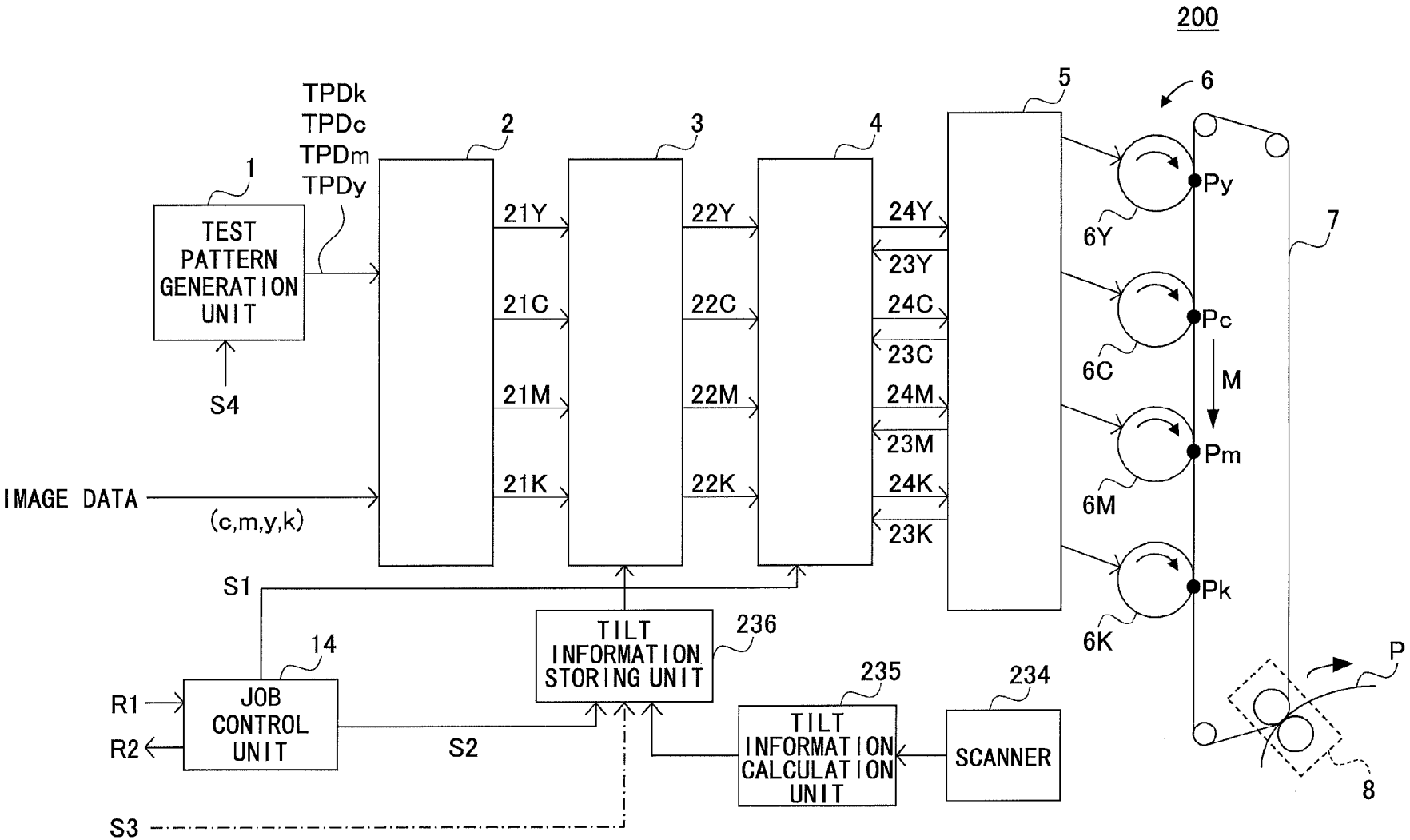
FIG. 18 is a block diagram for explaining an example of an overall structure of the image forming apparatus of the third embodiment.

FIG. 18 is a block diagram for explaining an example of an overall structure of an image forming apparatus 200 of the third embodiment. For the image forming apparatus 200 illustrated in FIG. 18, the same components as those of the image forming apparatus 100 illustrated in FIG. 1 or the like are given the same reference numerals, explanations are not repeated and points that differ are mainly explained.

The image forming apparatus 200 includes the test pattern generation unit 1, the image path switching unit 2, the image data correction unit 3 and the writing control unit 4 in addition to the scanning optical systems 5, the photosensitive drums 6, the intermediate transfer belt 7 and the secondarily transfer unit 8 illustrated also in FIG. 17. The image forming apparatus 200 further includes a scanner 234, a tilt information calculation unit 235, a tilt information storing unit 236 and the job control unit 14.

In this embodiment, the image data correction unit 3 corrects the input image data such that an image formed on the printing medium P becomes at an appropriate position with an appropriate shape with respect to the printing medium P. Specifically, the image data correction unit 3 corrects the normal image data based on tilt information stored in the tilt information storing unit 236. The tilt information is explained later in detail. The image data correction unit 3 outputs image data 22Y, 22C, 22M and 22K whose tilt (inclination) is corrected to the writing control unit 4.

The scanner 234 performs a scanning operation and reads information by a sensor. Specifically, the scanner 234 reads test patterns for detecting tilt (third test patterns) formed at four corners of the printing medium P and outputs the read result to the tilt information calculation unit 235. The read result output to the tilt information calculation unit 235 includes coordinate values or distances of the test patterns for detecting tilt or the like.

The tilt information calculation unit 235 calculates the tilt of the printing medium based on the input read result. When the read result input from the scanner 234 is coordinate values of the test patterns for detecting tilt, the tilt information calculation unit 235 calculates an angle "θ", which is the tilt amount of the printing medium, from the coordinate values, and calculates tilt information that is used by the image data correction unit 3 for correction. A specific method of calculation is explained later in detail.

The tilt information storing unit 236 stores the tilt information of the printing medium. The tilt information of the printing medium is, for example, a rotation matrix based on the tilt amount θ of the printing medium with respect to an orthogonal direction of the medium conveying direction, for example. The tilt angle θ is input by the tilt information calculation unit 235.

(Tilt of Printing Medium in Medium Conveying Direction)

Figure 19:
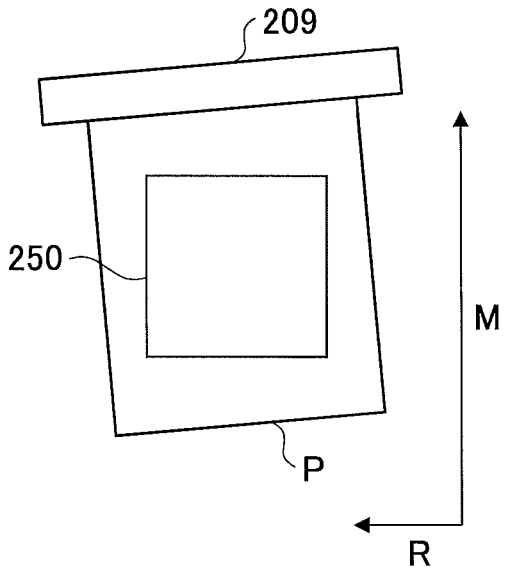
FIG. 19 is a view for explaining a generation of a tilt factor caused by a position of a registration roller.

FIG. 19 is a view for explaining a generation of a tilt factor caused by a position of the registration roller 209.

The image forming apparatus 200 strikes the printing medium P to the registration roller 209 to align a front end of the printing medium P as a pretreatment of forming an image.

FIG. 19 illustrates a status where the printing medium P is conveyed to the registration roller 209 and is struck by the registration roller 209. Ideally, the registration roller 209 should extend in a direction "R" orthogonal to a medium conveying direction "M". However, there may be a case that the registration roller 209 is tilted with respect to the orthogonal direction "R" of the medium conveying direction "M" due to a change over time, a repairing operation or the like as illustrated in FIG. 19. In such a case, the printing medium P becomes also tilted with respect to the conveying direction "M". However, the image forming apparatus 200 is configured to form an image in an image forming area 50 that is defined assuming that left and right side edges of the printing medium P are in parallel with the medium conveying direction "M". In such a case, as illustrated in FIG. 19, the image that is not in parallel with left and right side edges of the printing medium P is formed.

Figure 20A:
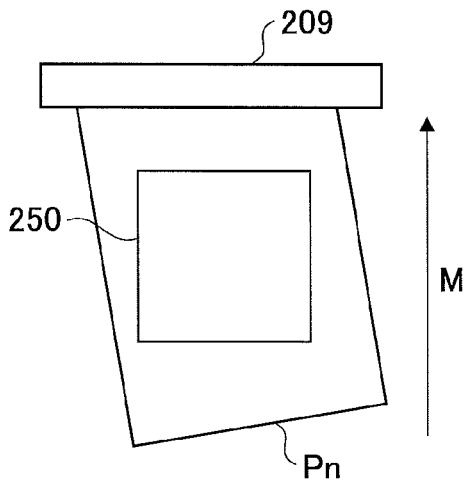
FIG. 20A to FIG. 20C are views for explaining a tilt factor caused by using a printing medium having a non-rectangular shape.

FIG. 20A illustrates a case when a printing medium Pn having a non-rectangular shape and whose front end and rear end are not extending in the orthogonal direction of the medium conveying direction "M" is used.

As illustrated in FIG. 20A, when the printing medium Pn having the non-rectangular shape is struck by the registration roller 209, even when the registration roller 209 is positioned at a right position, in other words, even when the registration roller 209 is provided to extend in an orthogonal direction with respect to the medium conveying direction "M", the image forming area 50 is formed not to be in parallel with left and right side edges of the printing medium Pn.

Figure 20B:
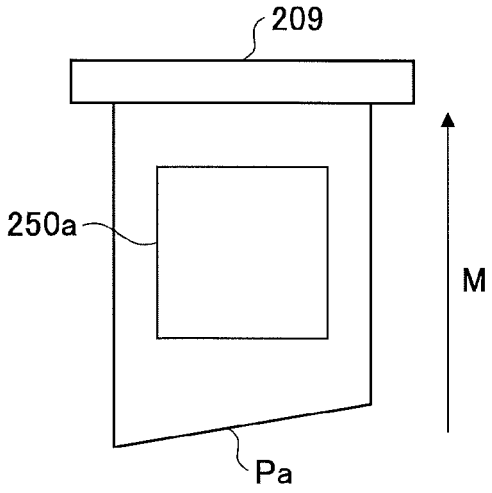
Figure 20C:
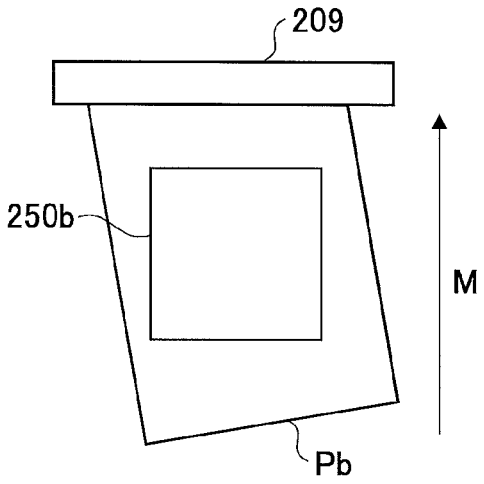

Further, as illustrated in FIG. 20B and FIG. 20C, when images are formed on both sides of the printing medium, and the printing medium having the non-rectangular shape is used, even when an image (an image forming area 250*a*) that is in parallel with left and right side edges of the printing medium is formed at a front surface Pa, an image (an image forming area 250*b*) that is not in parallel with the left and right side edges of the printing medium if formed at a back surface Pb.

(Test Chart for Obtaining Tilt Information and Method of Forming Image Based on Tilt Information)

Figure 21:
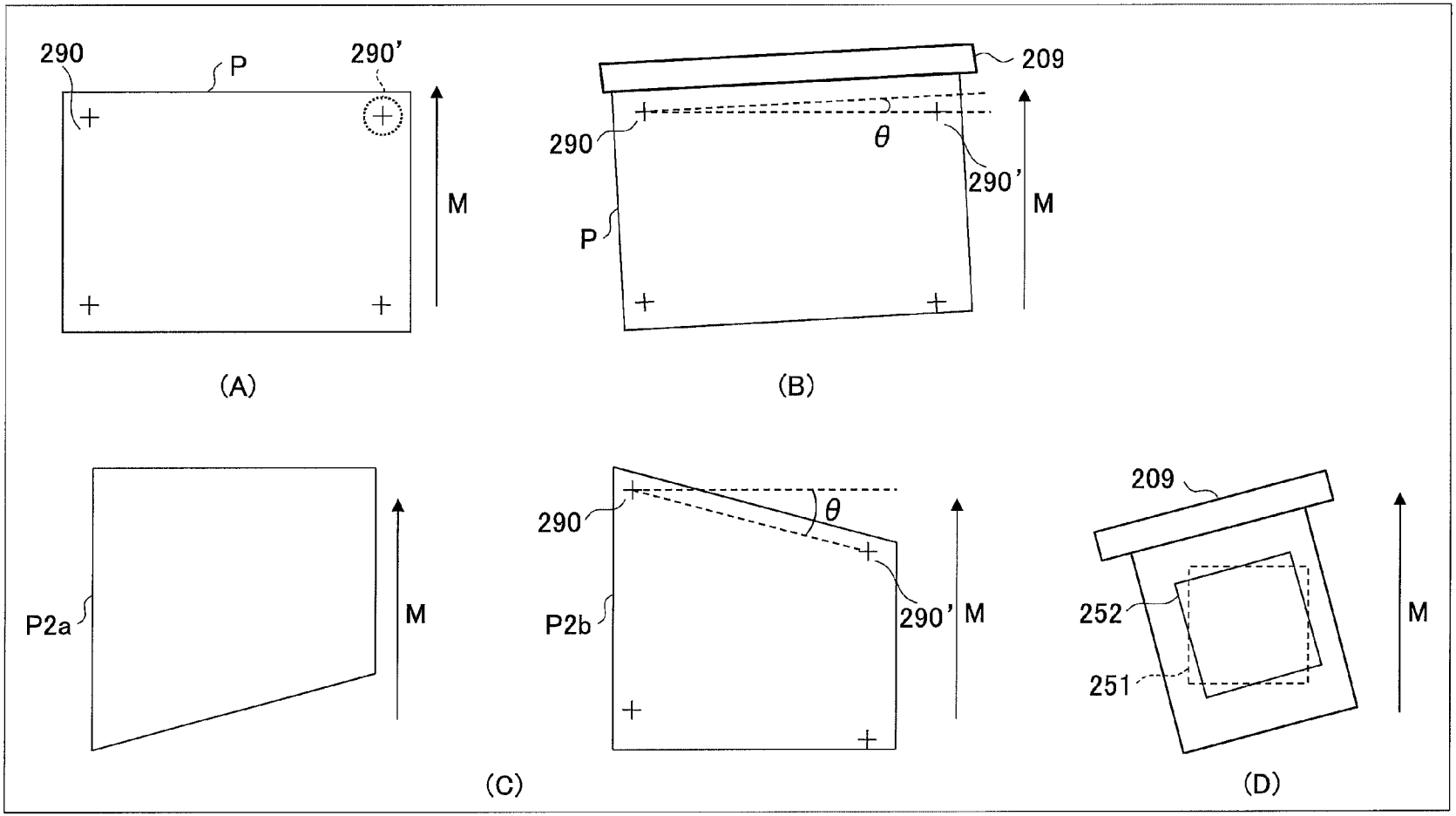
FIG. 21 is a view illustrating an example of a test chart for obtaining tilt information and a method of correction based on the tilt information.

FIG. 21 is a view illustrating an example of a test chart for obtaining the tilt information and a method of correction based on the tilt information.

First, test patterns (fourth test patterns) 290 or 290' each having a cruciform are formed at four corners of the printing medium P. Here, the test patterns formed at a right side in FIG. 21 are expressed as "290'''".

As illustrated in (A) of FIG. 21, when the registration roller 209 is not tilted and the printing medium P has a rectangular shape, the test patterns 290 and 290' are formed on lines extending in a direction orthogonal to the medium conveying direction "M" (tilt amount θ=0).

However, as illustrated in (B) of FIG. 21, when the registration roller 209 is tilted with respect to the medium conveying direction "M", as the test patterns 290 and 290' are formed after striking the printing medium P to the registration roller 209, the test patterns 290 and 290' are formed to have a tilt amount θ with respect to a striking surface of the registration roller 209.

In FIG. 21, (C) illustrates an example in which the printing medium has a non-rectangular shape. A left side view of (C) illustrates a front surface P2a of the printing medium and a right side view in (C) illustrates a back surface P2b of the printing medium. When an image is formed on the front surface P2a of the printing medium, it is assumed that a rear edge is not orthogonal with respect to the medium conveying direction "M".

At this time, when an image is formed on the back surface P2b of the printing medium, a front edge is not orthogonal with respect to the medium conveying direction "M" as illustrated in the right side view. Thus, an image of the test patterns formed on the back surface P2b is tilted with respect to an image of the test patterns formed on the front surface P2a and also tilted with respect to the striking surface of the resist roller 209.

The coordinates of the test patterns 290 and 290' are obtained by reading by the scanner 234. The scanner 234 outputs the read coordinate values of the patterns 290 and 290' to the tilt information calculation unit 235.

The tilt information calculation unit 235 calculates an angle (tilt amount) θ, that is the tilt amount of the printing medium, between the test patterns 290 and 290' and the striking surface of the registration roller 209 from the coordinate values. The tilt information calculation unit 235 calculates the tilt information based on the calculated tilt amount. A method of calculating the tilt information based on the tilt amount is explained later. The calculated result is output to the tilt information storing unit 236 and the tilt information storing unit 236 stores the tilt information.

The scanner 234 may be configured to directly measure the value of "θ".

The tilt information for the printing medium having the non-rectangular shape may be deleted from the tilt information storing unit 236 after an image is formed on the printing medium having the non-rectangular shape.

Further, when the registration roller 209 is tilted, as the tilted amount does not change as long as the registration roller 209 is replaced by a repairing operation or the like, the tilt information may be stored in the tilt information storing unit 236 to be used again until the value is updated.

In addition, the tilt information of the printing medium may be calculated at an arbitrary timing when a tilt of the printing medium is detected such as at the time of the repairing operation, at the time of setting the setting condition of the printing medium or the like, because the tilt information may change due to cutting of the printing medium or a setting direction of the printing medium.

The value of "θ" becomes the same for various colors. Alternatively, the value of "θ" may be separately calculated for each color.

Next, a method of forming an image based on the tilt information is explained.

With reference to (D) of FIG. 21, an image is formed in an image area 251 on the printing medium P presuming that the printing medium P is in parallel with the conveying direction "M". Thus, if the tilt information is not used, the image area 251 is set not to be in parallel with the left and right side edges of the printing medium P. According to the embodiment, in order to correct such a tilt of the image area 251, an image (image area 252) is formed to be tilted for "θ" with respect to the conveying direction "M" on the printing medium based on the tilt amount θ.

The image data correction unit 3 forms image data to form an image in the image area 252 from an input image. The tilt information is input to the image data correction unit 3 from the tilt information storing unit 236 and input image data 21Y, 21C, 21M and 21K are input to the image data correction unit 3 from the image path switching unit 2.

Here, coordinate systems of the image data 21Y, 21C, 21M and 21K input to the image data correction unit 3 are expressed as (x, y) and coordinate systems of corrected image data 22Y, 22C, 22M and 22K output from the image data correction unit 3 are expressed as (x', y').

As illustrated in the following equation 22, an output image (x', y') is calculated by correcting an input image (x, y) by performing a rotation based on the tilt amount "$\theta_1$".

$$\begin{pmatrix} x' \\ y' \\ 1 \end{pmatrix} = \begin{pmatrix} \cos\theta_1 & -\sin\theta_1 & 0 \\ \sin\theta_1 & \cos\theta_1 & 0 \\ 0 & 0 & 1 \end{pmatrix} \begin{pmatrix} x \\ y \\ 1 \end{pmatrix} \tag{22}$$

The tilt information storing unit 236 stores a calculated result (components of the matrix) based on the tilt amount "$\theta_1$" used in the equation 22, as the tilt information.

When forming images on both surfaces, the tilt information storing unit 236 separately stores the tilt amount "$\theta_1$" for a front surface and the tilt amount $\theta_2$ for a back surface. Then, when forming an image on the front surface, the output image is calculated using equation 22. Subsequently, when forming an image on the back surface, the image data correction unit 3 reads out tilt information based on a tilt amount "$\theta_2$", that is for the back surface, from the tilt information storing unit 236 and uses the tilt amount "$\theta_2$" instead of "$\theta_1$" for equation 22. With this, images are formed in different ways for the front surface and the back surface. A user may select the front surface or the back surface to which an image is formed by the data selection signal "S3".

Fourth Embodiment (Overall Structure of Image Forming Apparatus: Block Diagram)

Figure 22:
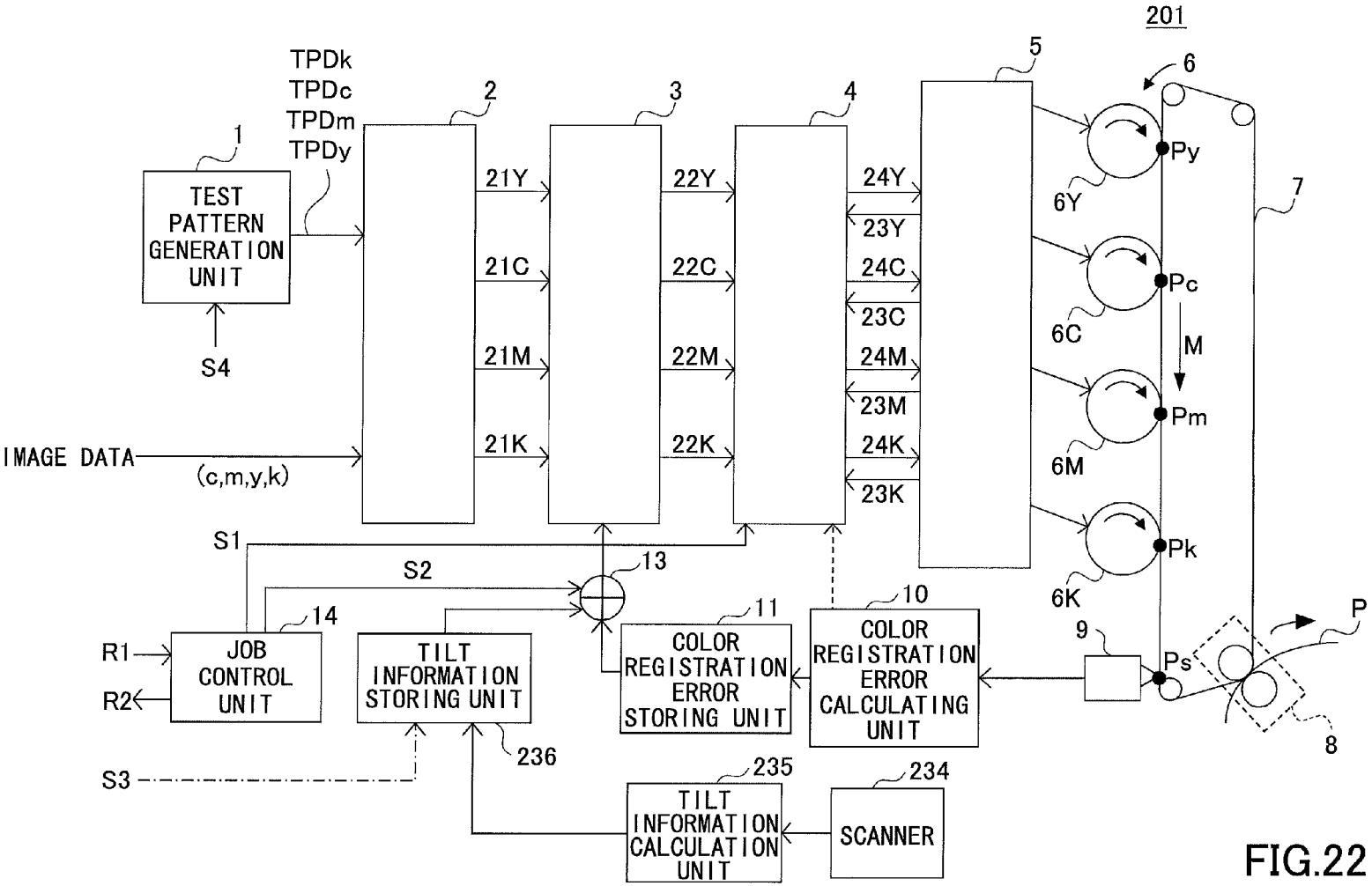
FIG. 22 is a block diagram for explaining an example of an overall structure of the image forming apparatus of a fourth embodiment.

FIG. 22 is a block diagram for explaining an example of an overall structure of an image forming apparatus 201 of a fourth embodiment. For the image forming apparatus illustrated in FIG. 22, the same components as those of the image forming apparatus 100 illustrated in FIG. 1, the image forming apparatus 200 illustrated in FIG. 18 or the like are given the same reference numerals, explanations are not repeated and points that differ are mainly explained.

As illustrated in FIG. 22, the image forming apparatus 201 includes the test pattern detection unit 9, the color registration error amount calculation unit 10, the color registration error storing unit 11 and the adding unit 13 in addition to the components of the image forming apparatus 200 illustrated in FIG. 18.

In this embodiment, the adding unit 13 calculates added information for performing a correction based on the color registration error amount obtained from the color registration error storing unit 11 and a correction based on the tilt information obtained from the tilt information storing unit 236 to output to the image data correction unit 3. A method of correction based on the added information of the color registration error amount and the tilt information is explained later in detail.

The adding unit 13 outputs the added information to the image data correction unit 3 when a signal to form an image is output from the job control unit 14.

Further, the adding unit 13 may separately output the color registration error amount or the tilt information instead of the added information.

(Method of Correction Based on Added Information of Color Registration Error Amount and Tilt Information)

A method of correction based on the added information of the tilt information of the printing medium due to the tilt or the like of the registration roller 209 and the color registration error amount is explained.

When forming an image after correcting both the tilt of the printing medium and the color registration error, the following equation 23 is used.

$$\begin{pmatrix} x' \\ y' \\ 1 \end{pmatrix} = A^{-1} \cdot B \cdot \begin{pmatrix} x \\ y \\ 1 \end{pmatrix} \tag{23}$$

Here, "B" is as follows.

$$B = \begin{pmatrix} \cos\theta_1 & -\sin\theta_1 & 0 \\ \sin\theta_1 & \cos\theta_1 & 0 \\ 0 & 0 & 1 \end{pmatrix} \tag{24}$$

The color registration error correction matrix, similar to equation 8 as described in the first embodiment, and a matrix to rotate an image (herein after, also referred to as "rotation matrix") based on the tilt information of the printing medium are multiplied. With this, both of the color registration error and the tilt of the printing medium can be corrected.

Here, a matrix "C" (hereinafter, also referred to as an "added matrix") that is obtained by multiplying the color registration error correction matrix and the rotation matrix as described in the following equation 25 may be used.

$$C = A^{-1} \cdot B \tag{25}$$

When using the added matrix of equation 25, by using the following equation 26 instead of the above described equation 23, the calculation amount can be reduced compared with a case when the color registration error correction matrix and the rotation matrix are separately multiplied for each coordinate and the process time can be reduced.

$$\begin{pmatrix} x' \\ y' \\ 1 \end{pmatrix} = C \cdot \begin{pmatrix} x \\ y \\ 1 \end{pmatrix} \tag{26}$$

Further, when forming images on both surfaces, the tilt information of the printing medium P for the front surface and the back surface are separately stored in the tilt information storing unit 236. Then, when forming an image on the back surface, the tilt information for the back surface based on the tilt amount $\theta_2$ is read out from the tilt information storing unit 236 and the following equation 24-1 is used for the rotation matrix instead of the above described equation 24. With this, the images can be formed on the front surface and the back surface corresponding to different tilts.

$$B = \begin{pmatrix} \cos\theta_2 & -\sin\theta_2 & 0 \\ \sin\theta_2 & \cos\theta_2 & 0 \\ 0 & 0 & 1 \end{pmatrix} \tag{24-1}$$

Fifth Embodiment (Overall Structure of Image Forming Apparatus: Block Diagram)

Figure 23:
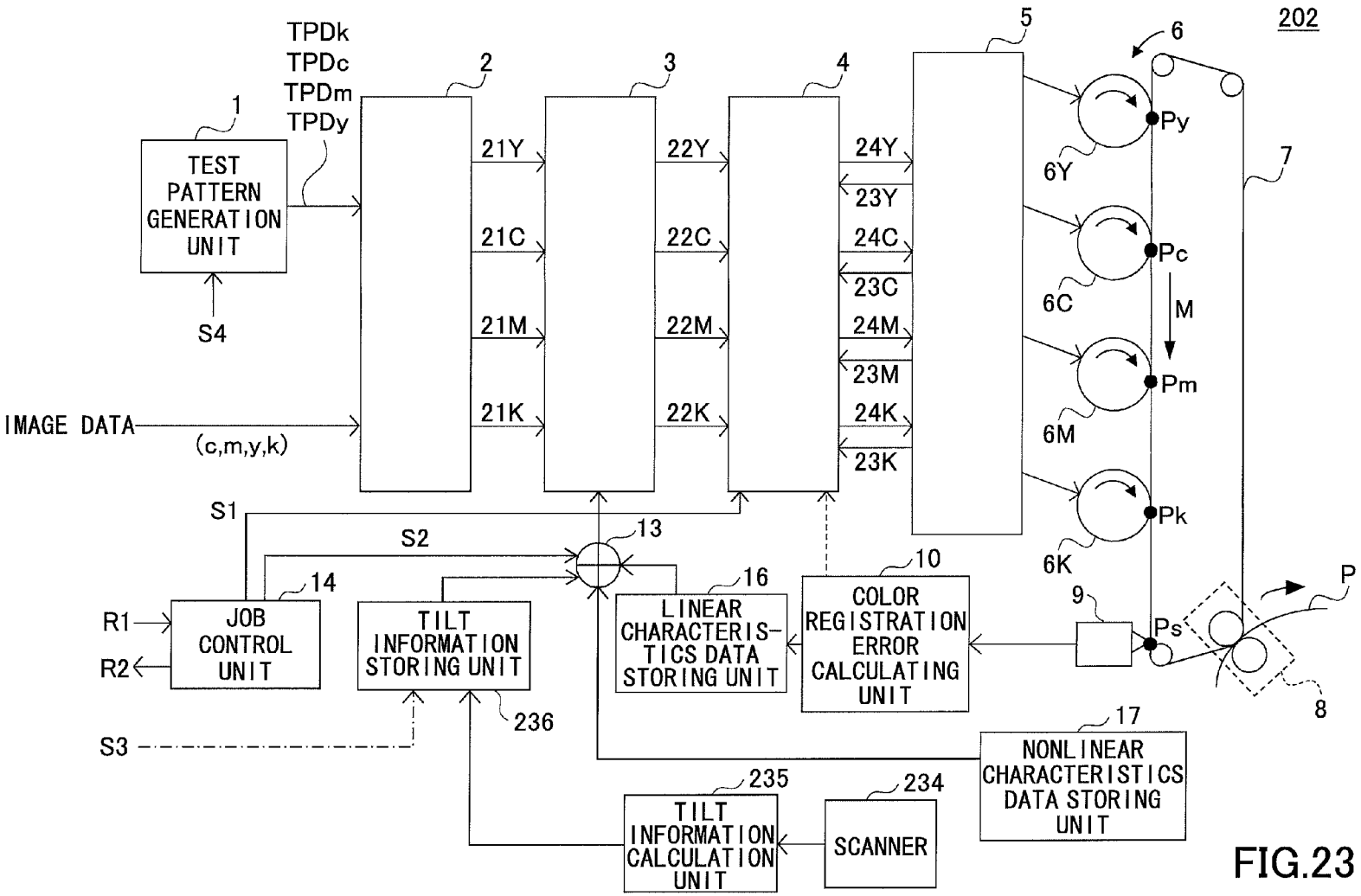
FIG. 23 is a block diagram for explaining an example of an overall structure of the image forming apparatus of a fifth embodiment.

FIG. 23 is a block diagram for explaining an example of an overall structure of the image forming apparatus of a fifth embodiment. For the image forming apparatus illustrated in FIG. 23, the same components as those of the image forming apparatus 100 illustrated in FIG. 1, the image forming apparatus 200 illustrated in FIG. 18, the image forming apparatus 201 illustrated in FIG. 22 or the like are given the same reference numerals, explanations are not repeated and points that differ are mainly explained.

As illustrated in FIG. 23, the image forming apparatus 202 includes the linear characteristics data storing unit 16 and the nonlinear characteristics data storing unit 17 instead of the color registration error storing unit 11 of the image forming apparatus 201 illustrated in FIG. 22.

Similar to the second embodiment, in the fifth embodiment, different from the fourth embodiment, the color registration error amount is categorized into characteristics data corresponding to each factor (component). This means that the color registration error amount is categorized into linear characteristics data that corresponds to a factor indicating linear characteristics and nonlinear characteristics data that corresponds to a factor indicating nonlinear characteristics and separately stored.

In this embodiment, the adding unit 13 adds the linear characteristics component of the color registration error amount obtained from the linear characteristics data storing unit 16 and the nonlinear characteristics component obtained from the nonlinear characteristics data storing unit 17 to calculate the characteristics data of the color registration error amount. Further, the adding unit 13 calculates added information for performing a correction based on the characteristics data of the calculated color registration error amount and a correction based on the tilt information to output to the image data correction unit 3.

The adding unit 13 outputs the added information to the image data correction unit 3 when a signal to form an image is output from the job control unit 14.

Further, the adding unit 13 may separately output the color registration error amount, the linear characteristics data, the nonlinear characteristics data or the tilt information instead of the added information.

In this embodiment, the image is formed after correcting the tilt of the printing medium in addition to correct the color registration error of the nonlinear components.

For the correction of a case when the registration roller 209 is tilted with respect to the orthogonal direction of the medium conveying direction, or when the printing medium P has the non-rectangular shape, the tilt amount "$\theta_1$" is read out from the tilt information storing unit 236 to rotate the image for "$\theta_1$". At this time, the above described equation 23 of the fourth embodiment is used while substituting the "$A^{-1}$" by the inverse matrix "$Ai^{-1}$" of the color registration error conversion matrix "Ai" of each area (equation 18 in the second embodiment).

Further, when forming images on both surfaces, the tilt information of the printing medium P for the front surface and the back surface are separately stored in the tilt information storing unit 236. Then, when forming an image on the back surface, the tilt information for the back surface based on the tilt amount $\theta_2$ is read out from the tilt information storing unit 236. Then, the above described equation 23 and equation 24-1, instead of equation 24, of the fourth embodiment are used while substituting the "$A^{-1}$" by the inverse matrix "$Ai^{-1}$". With this, the images can be formed on the front surface and the back surface corresponding to different tilts.

Thus, the tilt, the color registration error (linear characteristics) and the nonlinear characteristics of the color registration error can be corrected.

According to the above embodiments, a color registration error of a back surface due to a contraction after printing an image on a front surface can be controlled in real time.

According to the above embodiments, an image can be formed on a printing medium after tilting image data in accordance with a tilt of a printing medium.

Although a preferred embodiment of the image forming apparatus and method of correcting an image to be formed has been specifically illustrated and described, it is to be understood that minor modifications may be made therein without departing from the spirit and scope of the invention as defined by the claims.

The present invention is not limited to the specifically disclosed embodiments, and numerous variations and modifications and modifications may be made without departing from the spirit and scope of the present invention.

The present application is based on and claims the benefit of priority of Japanese Priority Application No. 2012-274063 filed on Dec. 14, 2012, and Japanese Priority Application No. 2013-099655 filed on May 9, 2013, and the entire contents of which are hereby incorporated by reference.

What is claimed is:

1. An image forming apparatus comprising:

a color registration error amount calculation unit that calculates a color registration error amount from a first test pattern;

a correction information obtaining unit that obtains a correction information for correcting an image on a back surface based on previously obtained contraction information of a printing paper after printing an image on a front surface when printing on both surfaces; and an image data correction unit that corrects the image on the back surface based on the color registration error amount calculated by the color registration error amount and the correction information obtained by the correction information obtaining unit, wherein the correction information obtaining unit obtains the correction information based on a detected result of a second test pattern that is formed at a predetermined position of the printing paper after the printing paper passes through a fixing device and returns to its original size.

2. The image forming apparatus according to claim 1, wherein the correction information obtaining unit obtains, as the correction information, a correction value of a main-scanning position and a main-scanning magnification of the image on the back surface.

3. The image forming apparatus according to claim 2, wherein the image data correction unit corrects the image on the back surface using the correction value of the main-scanning position and the main-scanning magnification obtained for each line in a sub-scanning direction of the image on the back surface.

4. The image forming apparatus according to claim 1, wherein the correction information obtaining unit obtains the correction information based on a detected result at a contracted state after the printing paper on which the second test pattern is formed passes through a fixing device.

5. The image forming apparatus according to claim 4, wherein the correction information obtaining unit obtains the correction information based on the detected result at the contracted state after the printing paper on which the second test pattern is formed passes through the fixing device and a set value of the second test pattern and a set value of the second test pattern formed on the printing paper.

6. The image forming apparatus according to claim 1, further comprising:

a nonlinear storing unit that previously stores nonlinear characteristics data of a color registration error amount, and wherein the image data correction unit corrects each area of the image on the back surface based on the nonlinear characteristics data obtained from the nonlinear storing unit, the color registration error amount, and the correction information.

7. The image forming apparatus according to claim 1, wherein the first test pattern is formed at an outside of an image forming area.

8. A method of correcting a color registration error performed by an image forming apparatus, comprising:

a calculation step of calculating a color registration error amount from a first test pattern;

an obtaining step of obtaining correction information for correcting an image on a back surface based on previously obtained contraction information of a printing paper after printing an image on a front surface when printing on both surfaces; and a correction step of correcting the image on the back surface based on the color registration error amount calculated in the calculation step and the correction information obtained in the obtaining step, wherein in the obtaining step, the correction information is obtained based on a detected result of a second test pattern that is formed at a predetermined position of the printing paper after the printing paper passes through a fixing device and returns to its original size.

9. An image forming apparatus comprising:

a tilt information storing unit that stores tilt information regarding a printing medium;

an image forming unit that forms an image corrected based on the tilt information on an image forming area of a printing medium; and an adding unit that calculates added information for performing an added correction of a correction based on the tilt information and a correction based on a nonlinear component of a color registration error amount calculated from a fourth test pattern, and wherein the image forming unit forms an image corrected based on the added information.

10. The image forming apparatus according to claim 9, further comprising:

a tilt information calculation unit that calculates the tilt information, and wherein the tilt information calculation unit reads a coordinate value of a third test pattern, calculates a tilt amount with respect to a medium conveying direction from the coordinate value, and calculates the tilt information from the tilt amount.

11. The image forming apparatus according to claim 9, wherein when forming images on a front surface and a back surface of a printing medium and a front edge or a rear edge of the printing medium is not orthogonal with respect to a medium conveying direction, the image forming unit forms images corrected by different tilt information for the front surface and the back surface of the printing medium.

12. The image forming apparatus according to claim 9, wherein when forming images on a front surface and a back surface of a printing medium and a tilt of a printing medium is detected, the image forming unit forms images corrected by different tilt information for the front surface and the back surface of the printing medium.

* * * * *